US009471014B2

(12) United States Patent
Suzuki

(10) Patent No.: US 9,471,014 B2
(45) Date of Patent: Oct. 18, 2016

(54) HEATER CONTROL DEVICE AND IMAGE FORMING APPARATUS

(71) Applicant: Oki Data Corporation, Tokyo (JP)

(72) Inventor: Shuichi Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/858,482

(22) Filed: Sep. 18, 2015

(65) Prior Publication Data

US 2016/0216663 A1 Jul. 28, 2016

(30) Foreign Application Priority Data

Jan. 23, 2015 (JP) ..... 2015-011299

(51) Int. Cl.
*G03G 15/00* (2006.01)
*G03G 15/20* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/5004; G03G 15/80; G03G 21/14
USPC ..... 399/88, 37, 69; 219/216
See application file for complete search history.

(56) References Cited

U.S. PATENT DOCUMENTS 6,408,148 B1 * 6/2002 Yamamoto ..... G03G 15/5004 219/216
2007/0071479 A1 * 3/2007 Semma ..... G03G 15/5004 399/88
2010/0150595 A1 * 6/2010 Harris ..... G03G 15/2039 399/69
2013/0164016 A1 * 6/2013 Inukai ..... G03G 15/80 399/88
2013/0195497 A1 * 8/2013 Shimura ..... G03G 15/80 399/88
2015/0370216 A1 * 12/2015 Okada ..... G03G 15/2039 399/88

FOREIGN PATENT DOCUMENTS

JP 2013-235107 A 11/2013

* cited by examiner

*Primary Examiner* — Sophia S Chen
(74) *Attorney, Agent, or Firm* — Muncy, Geissler, Olds & Lowe, P.C.

(57) ABSTRACT

A heater control device includes a first voltage conversion part that generates a first voltage based on an external input voltage, a second voltage conversion part that generates a second voltage for supplying power to heater(s) based on the first voltage, a third voltage conversion part that generates a third voltage used at least in driving the heater(s) based on the first voltage, a capacitative element electrically connected to a path that connects the first voltage conversion part to the second voltage conversion part and connects the first voltage conversion part to the third voltage conversion part. The capacitative element is located in a section of the path used for connecting both to the second and to third voltage conversion part, and a control part that performs an operation stop control to stop the operation of at least one heater(s) if the external input voltage has dropped below a first threshold voltage.

20 Claims, 22 Drawing Sheets

Comparative Example

Fuser
150a
150b
15
26
Low Voltage Power Supply Part
Input Voltage Detection Circuit
265
S3
SW1a
SW1b
S1a
S1b
(1)
(2)
Vac2a
Vac2b
SW3
P1
Vdc1
261
PFC Circuit
264
262a
Switching Part
DC-AC Converter
262
262b
Switching Controller
Vdc3H
DC-DC Converter
263
SW2
(3)
Vdc3L
(For Logic Voltage)
S2
Timer
230
Print Controller
23
Vacin
8

Fuser
150a
150b
15
26
Low Voltage Power Supply Part
Input Voltage Detection Circuit
265
S3
Vdc1
261
PFC Circuit
P1
264
SW3
263
DC-DC Converter
P3
Vdc3H
Vdc3L
SW1a
SW1b
S1a
S1b
Vdc2a
Vdc2b
262
SW2
(To 251-256 etc.)
(For Logic Voltage)
S2
Print Controller
23
Timer
230
Vacin
8

HEATER CONTROL DEVICE AND IMAGE FORMING APPARATUS

CROSS REFERENCE

The present application is related to, claims priority from and incorporates by reference Japanese Patent Application No. 2015-011299, filed on Jan. 23, 2015.

TECHNICAL FIELD

This invention relates to a heater control device applied for heating a medium, and an image forming apparatus.

BACKGROUND

In an image forming apparatus using an electrophotographic system, a toner image formed on (transferred onto) a medium such as a sheet of paper by an image forming part is fused on the medium in a fuser device (fuser) (see Patent Document 1 for example). Image formation using an electrophotographic system is performed in this manner.

Also, members such as this fuser in the image forming apparatus include those utilizing a heating operation by a heater (heating member, heat generation body). Then, in the control device of such a heater, in general an electrolytic capacitor is provided.

RELATED ART DOCUMENTS

[Patent Document 1] Japanese Unexamined Patent Application 2013-235107

Incidentally, because a capacitative element such as an electrolytic capacitor having a large capacity had to be provided in a conventional heater control device, it was required to reduce the capacity of the capacitative element such as this electrolytic capacitor.

This invention was made considering such a problem, and its objective is to offer a heater control device that can reduce the capacity of its capacitative element and an image forming apparatus provided with such a heater control device.

SUMMARY

A heater control device disclosed in the application includes a first voltage conversion part that generates a first voltage based on an external input voltage that is input from an outside, a second voltage conversion part that generates a second voltage for supplying power to one or multiple heaters, which are provided inside the device, based on the first voltage, a third voltage conversion part that generates a third voltage used at least in driving the one or multiple heaters based on the first voltage, a capacitative element that is electrically connected to a path that connects the first voltage conversion part to the second voltage conversion part and connects the first voltage conversion part to the third voltage conversion part, further the capacitative element being located in a section of the path that is used for connecting both to the second and to third voltage conversion part, and a control part that performs an operation stop control to stop the operation of at least one of the one or multiple heaters if the external input voltage has dropped below a first threshold voltage.

In addition to the above heater control device, the application discloses an image forming apparatus including at least one image forming part and the above described heater control device.

According to the heater control device and the image forming apparatus of this invention, it becomes possible to reduce the capacity of the capacitative element.

DETAILED DESCRIPTION OF PREFERRED EMBODIMENT(S)

Below, embodiments of this invention will be explained in details referring to drawings. Besides, the explanations will be given in the following order:

1. Embodiments (Examples of image forming apparatus with the first~third switches provided.)
2. Modifications (Examples of image forming apparatus having other switch configurations, etc.)
3. Other modifications

1. Embodiments

Outline Configuration

Figure 1:
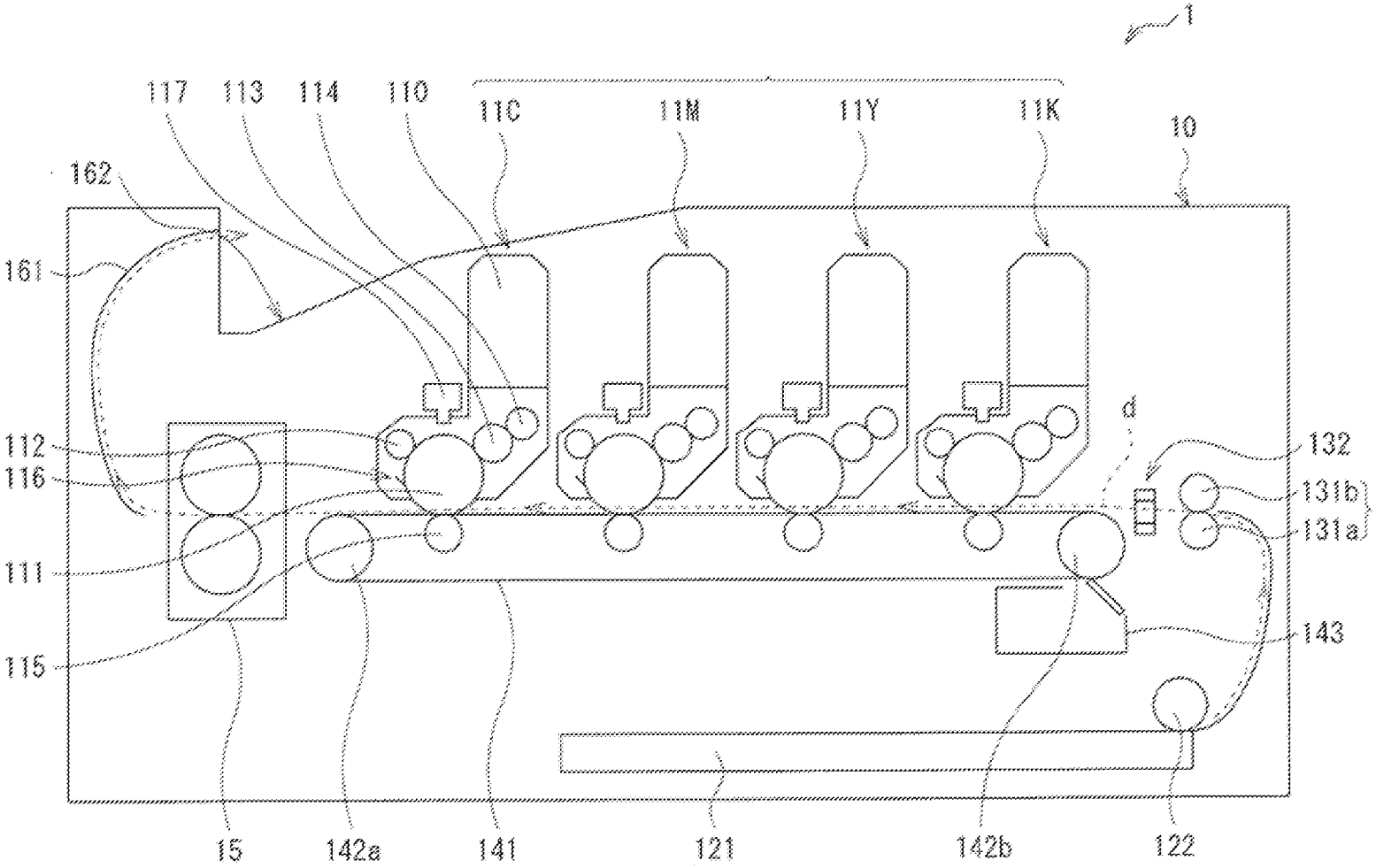
FIG. 1 is a schematic diagram expressing an outline configuration example of the image forming apparatus of an embodiment of this invention.

FIG. 1 schematically expresses an outline configuration example of the image forming apparatus (image forming apparatus 1) of an embodiment of this invention. The image forming apparatus 1 functions as a printer (color printer in this example) that forms an image (color image in this example) using an electrophotographic system on a recording medium that is, for example, a standard sheet.

As shown in FIG. 1, this image forming apparatus 1 is provided with four image forming parts 11C, 11M, 11Y, and 11K, a sheet cassette (sheet feeding tray) 121, a hopping roller (feed roller) 122, registration rollers (carrying rollers) 131*a* and 131*b*, and a sheet detection sensor 132. The image forming apparatus 1 is also provided with a transfer belt 141, a transfer belt drive roller 142*a*, a transfer belt driven roller 142*b*, a transfer belt cleaner container 143, a fuser (fuser device) 15, a sheet guide 161, and an ejection tray 162. Besides, as shown in FIG. 1, these members are contained in a specified chassis 10 having an openable top cover etc. (not shown). Also, these image forming parts 11C, 11M, 11Y, and 11K are integrally configured and detachably attached to the image forming apparatus 1.

The sheet cassette 121 is a member that contains the recording medium in a stacked state and is detachably attached to the lower portion inside the image forming apparatus 1.

The hopping roller 122 is a member (sheet feeding mechanism) that separates and extracts an individual sheet from the top of the recording media contained in the sheet cassette 121 and feeds it toward the registration rollers 131*a* and 131*b*.

The registration rollers 131*a* and 131*b* are members that sandwich and carry the recording medium fed from the hopping roller 122 toward the transfer belt 141 side while correcting the obliqueness of the recording medium.

The sheet detection sensor 132 is a sensor that detects, with or without contact, the passage of the recording medium (sheet) carried from the registration rollers 131*a* and 131*b*.

(Image forming parts 11C, 11M, 11Y, and 11K) As shown in FIG. 1, the image forming parts 11C, 11M, 11Y, and 11K are disposed in a row along the carrying direction (carrying path) d of the recording medium. Specifically, they are disposed in the order of the image forming parts 11K, 11Y, 11M, and 11C along this carrying direction d (from the upstream side toward the downstream side). Besides, as shown in FIG. 1, in this example this carrying path d is made as an S-shape path as the whole.

These image forming parts 11C, 11M, 11Y, and 11K form an image (toner image) on a recording medium using toners (developers) of different colors from one another. Specifically, an image drum unit 11C forms a toner image of cyan color using cyan (C) toner, and the image forming part 11M forms a toner image of magenta color using magenta (M) toner. In the same manner, the image forming part 11Y forms a toner image of yellow color using yellow (Y) toner, and the image drum unit 11K forms a toner image of black color using black (K) toner.

Each of these color toners is composed of a specified coloring agent, release agent, charging control agent, processing agent, etc. for example, and manufactured by appropriately mixing or surface-treating these ingredients. Among these, the coloring agent, the release agent, and the charging control agent function as internal additives. As external additives, silica, titanium oxide, etc. are used for example, and as binder resin, polyester resin etc. are used for example.

Also, as the coloring agent, dyes and pigments can be used alone or in combination of multiple types. Specifically, as these coloring agents for example, carbon black, iron oxide, Permanent Brown FG, Pigment Green B, Pigment Blue 15:3, Solvent Blue 35, Solvent Red 49, Solvent Red 146, quinacridone, Carmine 6B, naphthol, or disazoyellow, isoindoline, etc. can be used.

Here, the image forming parts 11C, 11M, 11Y, and 11K have the same configuration except for forming a toner image (developer image) using different color toners from one another as mentioned above. Below, an explanation will be given using the image forming part 11C as the representative among them.

As shown in FIG. 1, this image forming part 11C has a toner cartridge 110 (developer container), a photosensitive drum 111 (image carrier), a charging roller 112 (charging member), a development roller 113 (developer carrier), a supply roller 114 (supply member), a transfer roller 115 (transfer member), a cleaning blade 116 (cleaning member), and an exposure head 117 (exposure device).

The toner cartridge 110 is a container having the above-mentioned color toners contained. That is, in the case of this image forming part 11C, the toner cartridge 110 has the cyan toner contained. In the same manner, the toner cartridge 110 in the image forming part 11M has the magenta toner contained, the toner cartridge 110 in the image forming part 11Y has the yellow toner contained, and the toner cartridge 110 in the image forming part 11K has the black toner contained.

The photosensitive drum 111 is a member that carries an electrostatic latent image on the surface (surface layer portion) and is configured using a photosensitive body (for example, an organic-system photoreceptor). Specifically, the photosensitive drum 111 has a conductive supporting body and a photoconductive layer covering its outer circumference (surface). The conductive supporting body is configured of a metallic pipe made of aluminum for example. The photoconductive layer has, for example, a structure where a charge generation layer and a charge transportation layer are laminated in order. Besides, such photosensitive drum 111 rotates at a specified circumferential velocity.

The charging roller 112 is a member that charges the surface (surface layer portion) of the photosensitive drum 111 and is disposed so as to contact with the surface (circumferential face) of the photosensitive drum 111. This charging roller 112 has, for example, a metallic shaft and a semiconductive rubber layer (for example, semiconductive epichlorohydrin rubber layer) covering its outer circumference (surface). Besides, this kid of charging roller 112 rotates in the opposite direction from the photosensitive drum 111 for example.

The development roller 113 is a member that carries toner for developing the electrostatic latent image on its surface and is disposed so as to contact with the surface (circumferential face) of the photosensitive drum 111. This development roller 113 has, for example, a metallic shaft and a semiconductive urethane rubber layer covering its outer circumference (surface). Besides, such development roller 113 rotates at a specified circumferential velocity in the opposite direction from the photosensitive drum 111 for example.

The supply roller 114 is a member for supplying toner contained inside the toner cartridge 110 to the development roller 113, and is disposed so as to contact with the surface (circumferential face) of the development roller 113. This supply roller 114 has, for example, a metallic shaft and a foamed silicone rubber layer covering its outer circumference (surface). Besides, such supply roller 114 rotates in the same direction as the development roller 113 for example.

The transfer roller 115 is a member for electrostatically transferring the toner images formed inside the image forming parts 11C, 11M, 11Y, and 11K onto the recording medium. This transfer roller 115 is disposed opposing the photosensitive drum 111 across a transfer belt 141 mentioned below inside the image forming parts 11C, 11M, 11Y, and 11K. Besides, such transfer roller 115 is configured of a foamed semiconductive elastic rubber material.

The cleaning blade 116 is a member for scrape-removing (cleaning) toner remaining on the surface (surface layer portion) of the photosensitive drum 111. This cleaning blade 116 is disposed so as to counter-contact with the surface of the photosensitive drum 111 (protrude in the opposite direction of the rotation direction of the photosensitive drum 111). Such cleaning blade 116 is constituted of an elastic body such as polyurethane rubber for example.

The exposure head 117 is a device that forms an electrostatic latent image on the surface (surface layer portion) of this photosensitive drum 111 by exposing the surface of the photosensitive drum 111 with irradiation light. This exposure head 117 is supported by a top cover (not shown) of the chassis 10. The exposure head 117 comprises, for example, multiple light sources that emit irradiation light and a lens array that has this irradiation light form an image on the surface of the photosensitive drum 111. Besides, examples of these light sources include, for example, light emitting diode (LED), laser element, etc.

The transfer belt 141 is a belt that electrostatically adsorbs the recording medium carried from the registration rollers 131*a* and 131*b* and carries the recording medium along the carrying direction d. Also, the transfer belt drive roller 142*a* and the transfer belt driven roller 142*b* are members for operating this transfer belt 141. The transfer belt cleaner container 143 is a container for containing toner scraped off by the cleaning blade 116.

The fuser 15 is a device for fusing by adding heat and pressure to the toner (toner image) on the recording medium carried from the transfer belt 141. This fuser 15 comprises, for example, a fuser belt unit and a pressure roller (not shown) disposed opposing each other across the carrying path d of the recording medium. Besides, the fuser 15 is, for example, integrally attached to the image forming apparatus 1 or detachably attached to the image forming apparatus 1.

The sheet guide 161 is a guide member in ejecting the recording medium with toner fused by the fuser 15 to the outside of the image forming apparatus 1. Specifically, in this case as shown in FIG. 1, the recording medium ejected via the sheet guide 161 is ejected face-down toward the ejection tray 162 on the top cover (not shown) of the chassis 10. Besides, this ejection tray 162 is a part that stacks the recording media with images formed (printed).

Configuration of the Control Mechanism Etc.

Figure 2:
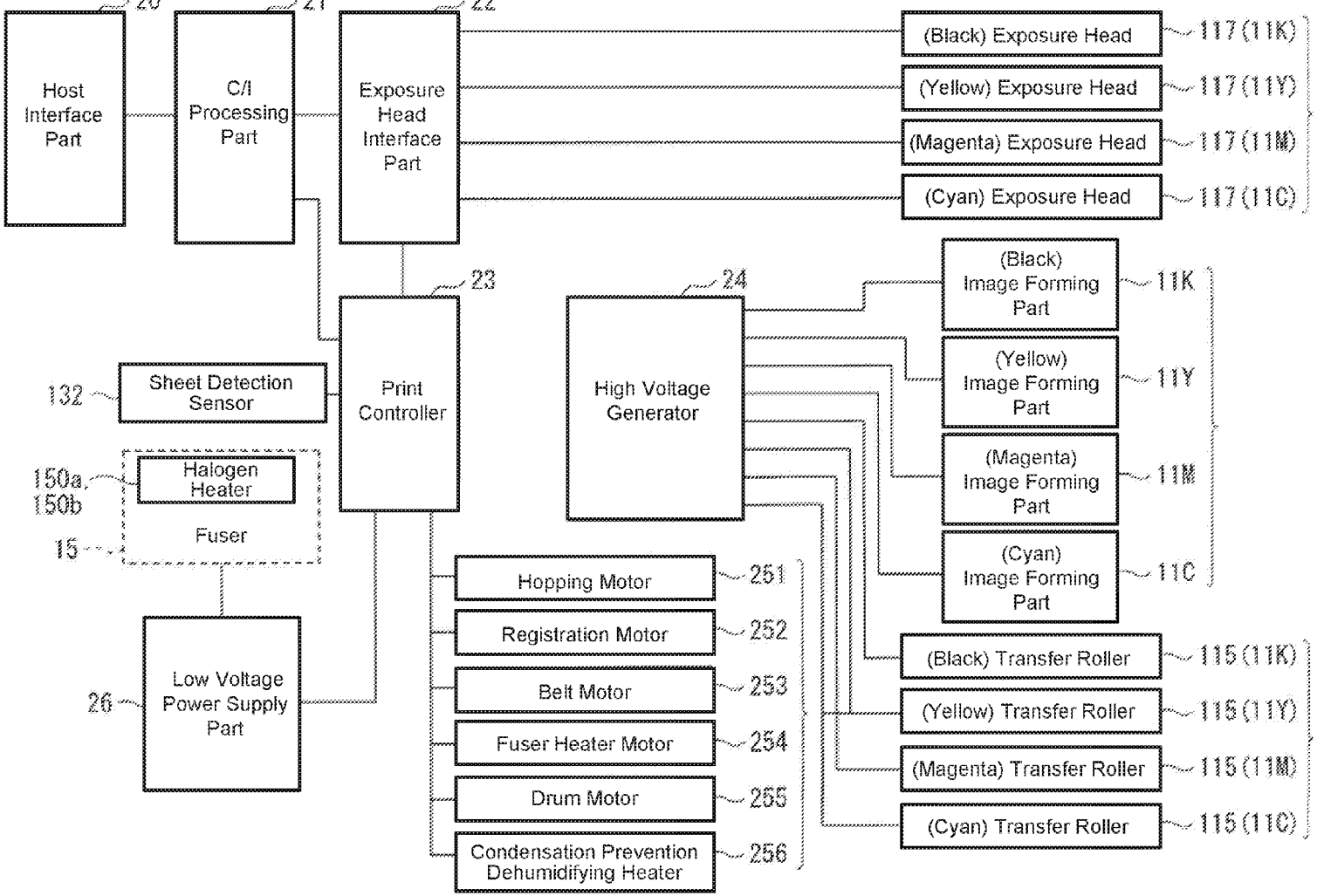
FIG. 2 is a block diagram expressing an example of the control mechanism etc. of the image forming apparatus shown in FIG. 1.

Here, referring to FIG. 2 and FIG. 3 in addition to FIG. 1, the control mechanism of the image forming apparatus 1 will be explained. FIG. 2 is a block diagram expressing an example of the control mechanism of such image forming apparatus 1 along with its control objects.

As shown in FIG. 2, in this example, the following items are provided as the control mechanism of the image forming apparatus 1. That is, a host interface part 20, a command/image processing part 21, an exposure head interface part 22, a print controller 23, a high voltage generator 24, the above-mentioned sheet detection sensor 132, and a low voltage power supply part 26.

The host interface part 20 performs data transmission with the command/image processing part 21. Specifically, for example, it has a function to provide the command/image processing part 21 with print data (print job, print command, etc.) supplied via a communication line from a host device (external equipment) such as a personal computer (PC). Besides, such print data is described, for example, in PDL (Page Description Language), etc.

The command/image processing part 21 performs specified processing to the print data supplied from the host interface part 20. By this, image data (for example, bit-map format image data) are supplied to the exposure head interface part 22, and at the same time, command data are supplied to the print controller 23.

As shown in FIG. 2, the exposure head interface part 22 controls the operation (emitting operation) of the exposure head 117 inside each of the image forming parts 11C, 11M, 11Y, and 11K according to the control from the print controller 23.

(Print controller 23) The print controller 23 has a function to control the whole image forming apparatus 1. Specifically, the print controller 23 has a function etc. to control the individual parts inside the image forming apparatus 1 to have a print process executed, etc. Specifically, as shown in FIG. 2, the print controller 23 has a function to control the operations of the high voltage generator 24, various types of driving mechanisms (in this example, a hopping motor 251, a resist motor 252, a belt motor 253, a fuser heater motor 254, a drum motor 255, and a dew condensation prevention dehumidifying heater 256 mentioned below), and the low voltage power supply part 26. Also, although the details will be mentioned below, the print controller 23 has a function to control the operations (heating operations) of halogen heaters 150*a* and 150*b* inside the fuser 15 via the low voltage power supply part 26.

Such print controller 23 is configured using a microcomputer that employs, for example, a CPU (Central Processing Unit), a ROM (Read Only Memory), a RAM (Random Access Memory), etc. Besides, this print controller 23 and the below-mentioned input voltage detection circuit 265 inside the low voltage power supply part 26 correspond to a specific example of the "controller" in this invention.

The high voltage generator 24 is a power supply part for applying a high voltage (bias) to the members (the charging roller 112, the development roller 113, the supply roller 114, the transfer roller 115, etc.) inside each of the image forming parts 11C, 11M, 11Y, and 11K according to the control from the print controller 23. Also, the amounts (absolute values)

of these high voltages etc. are controlled appropriately by the control from the print controller 23.

The hopping motor 251 is a motor for driving the hopping roller 122. The resist motor 252 is a motor for driving the registration rollers 131*a* and 131*b*. The belt motor 253 is a motor for driving the transfer belt 141 (the transfer belt drive roller 142*a* etc.). The fuser heater motor 254 is a motor for driving the below-mentioned halogen heaters 150*a* and 150*b* inside the fuser 15. The drum motor 255 is a motor for driving the photosensitive drum 111 inside each of the image forming parts 11C, 11M, 11Y, and 11K. The dew condensation prevention dehumidifying heater 256 is a dehumidifying heater for preventing dew condensation inside the chassis 10 of the image forming apparatus 1. Besides, this dew condensation prevention dehumidifying heater 256 corresponds to a specific example of the "one or multiple heaters" and the "dew condensation prevention heater" in this invention.

The low voltage power supply part 26 is a power supply part that generates various types of voltages based on the voltage supplied from the exterior (for example, the below-mentioned commercial power supply 8). This low voltage power supply part 26 also controls the operations of the below-mentioned halogen heaters 150*a* and 150*b* inside the fuser 15 according to the control from the print controller 23 as explained below in details.

Figure 3:
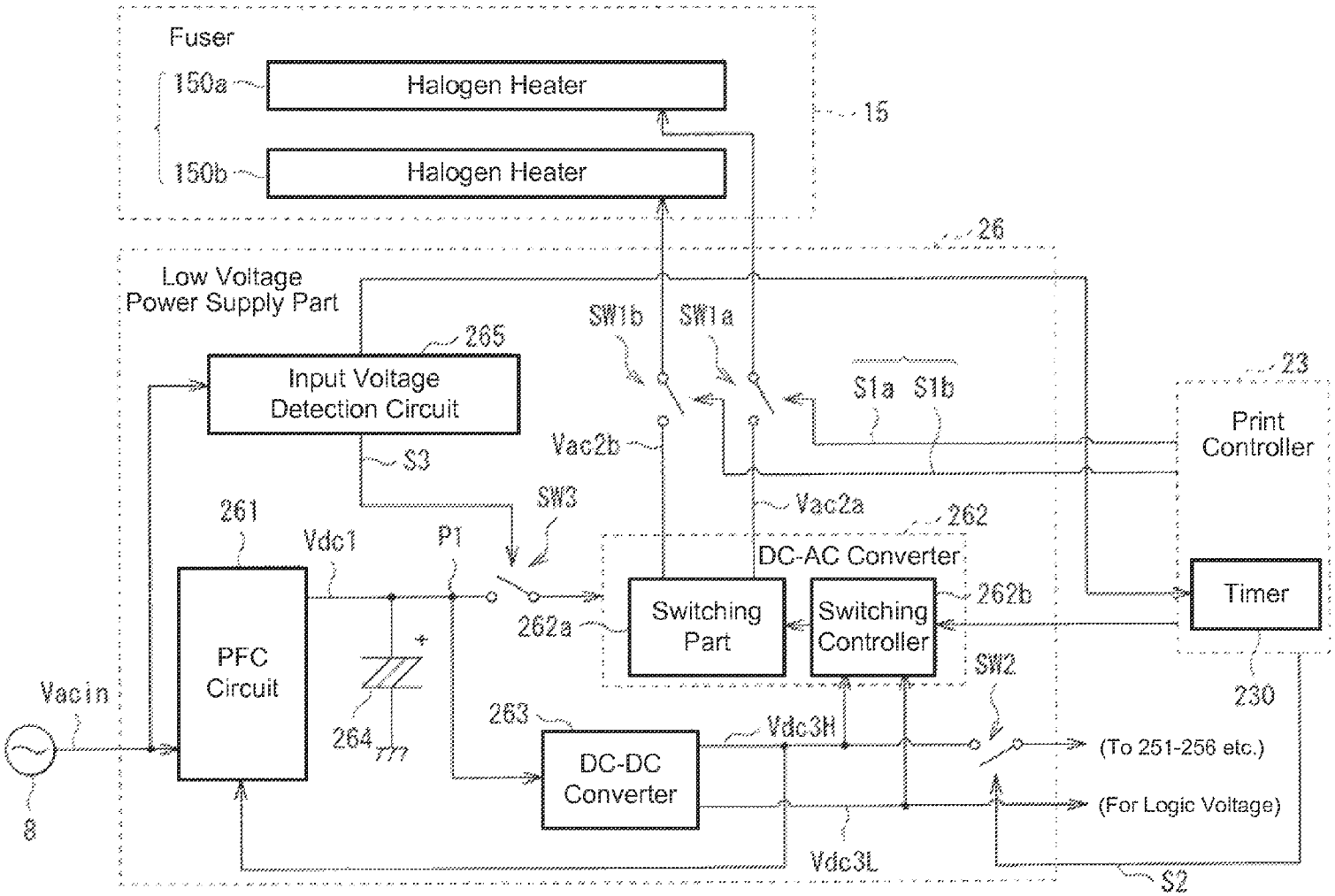
FIG. 3 is a schematic circuit diagram expressing a detailed configuration example of the heater and its control mechanism.

FIG. 3 is a circuit diagram expressing schematically a detailed configuration example of the halogen heaters 150*a* and 150*b* and their control mechanism (the print controller 23 and the low voltage power supply part 26) shown in FIG. 2. Besides, these print controller 23 and low voltage power supply part 26 correspond to a specific example of the "heater control device" in this invention.

Figure 4:
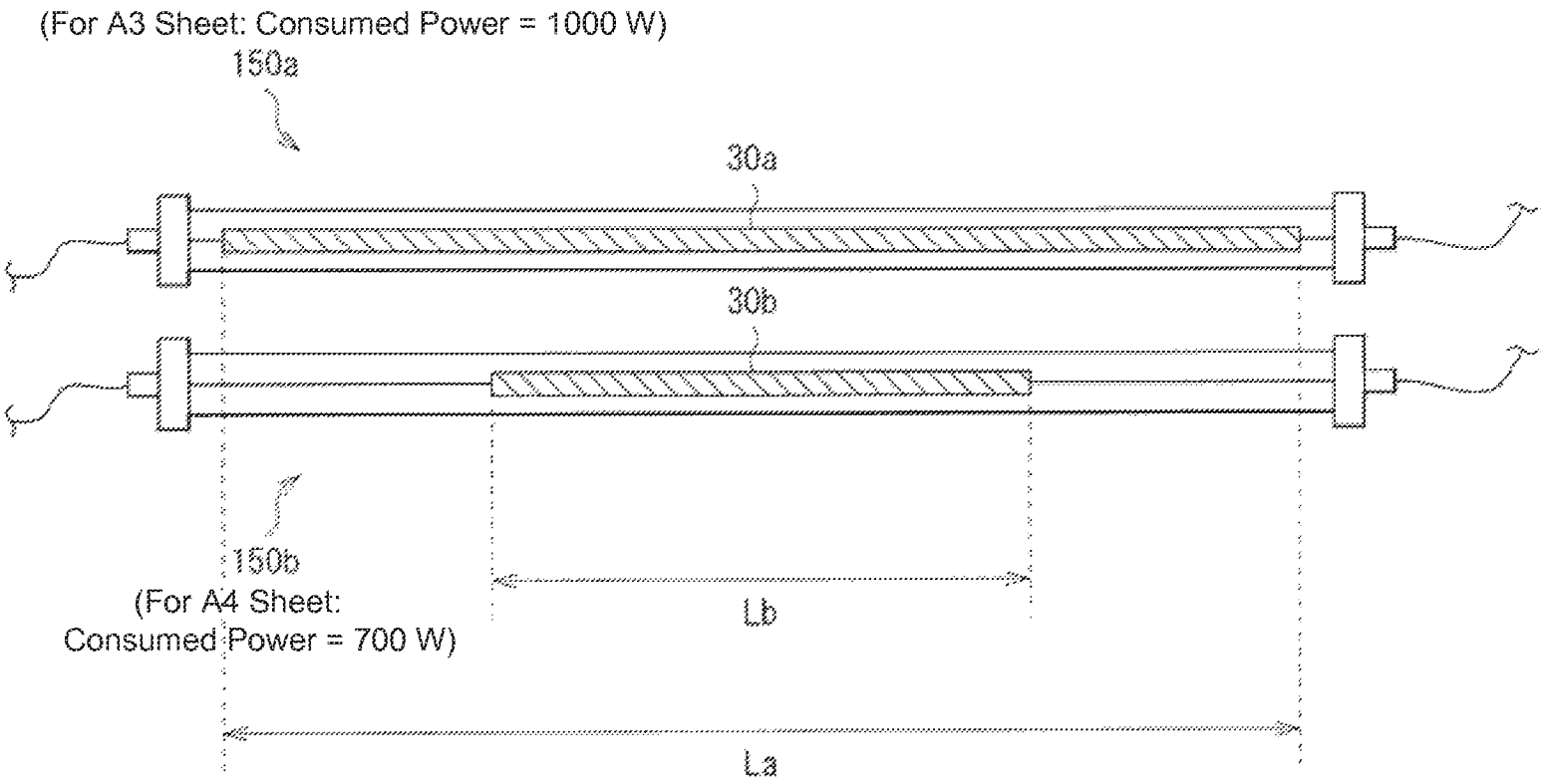
FIG. 4 is a schematic diagram illustrating two types of heaters shown in FIG. 3.

(Halogen heaters 150*a* and 150*b*) As shown in this FIG. 3, inside the fuser 15, there are multiple types of heaters (in this example, two kinds of halogen heaters 150*a* and 150*b*) are provided. FIG. 4 schematically expresses an outline configuration example of these two types of halogen heaters 150*a* and 150*b*.

As shown in FIG. 4, in this example, mounted in the halogen heater 150*a* is a filament (heat generation body) 30*a* having a heat generation length La corresponding to the sheet width of an A3-size sheet (recording medium) in the longitudinal feed. On the other hand, mounted in the halogen heater 150*b* is a filament 30*b* having a heat generation length Lb (<La) corresponding to the sheet width of an A4-size sheet in the longitudinal feed. As shown in FIG. 4 as an example, these halogen heaters 150*a* and 150*b* are heaters having different consumed power from each other. That is, the consumed power in the halogen heater 150*a* is set to 1000 W in this example, and the consumed power in the halogen heater 150*a* is set to 700 W in this example. Besides, these halogen heaters 150*a* and 150*b* correspond to a specific example of the "one or multiple heaters", "multiple types of heaters", and the "fuser heater" in this invention. These halogen heaters are grouped depending on their consumed power.

Here, the operations of these two types of halogen heaters 150*a* and 150*b* are controlled according to the control by the above-mentioned print controller 23 (using an ON/OFF operation control to the below-mentioned two types of switches SW1*a* and SW1*b*) in the following manner for example during the normal operation time (below-mentioned normal period ΔT0) of the fuser 15. That is, the control is performed considering the amount of the consumed power of each of the halogen heaters 150*a* and 150*b*, the size of the sheet that becomes the print target, the maximum power usable for the image forming apparatus 1 as the whole, etc. so that only one or both of the halogen heaters 150*a* and 150*b* will operate (perform a heating operation). Specifically, either both of them enter the operation state, or one operates in an auxiliary role for the other.

Figure 9:
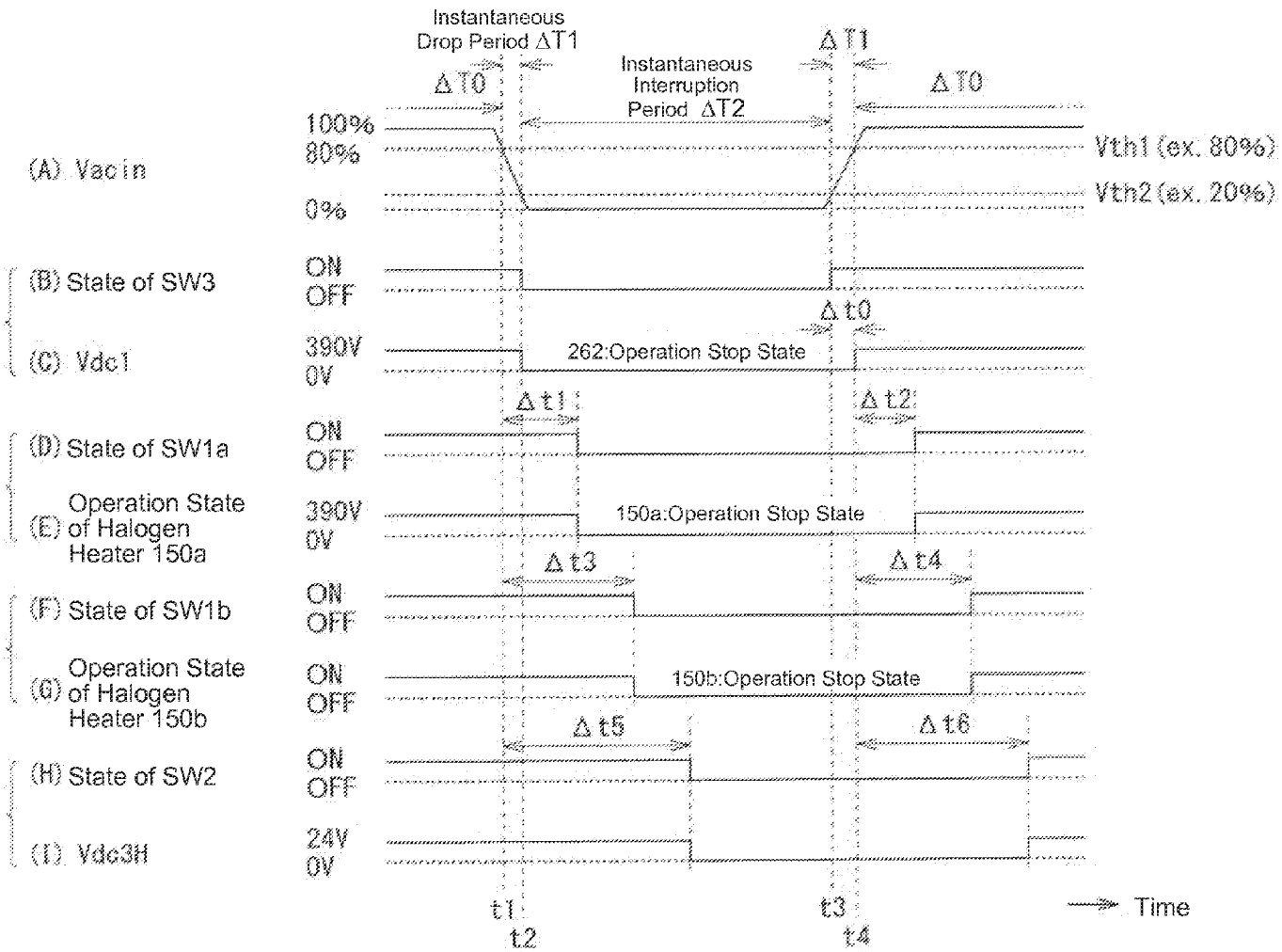
FIG. 9 is a timing waveform chart expressing an example of the control operation of the heater etc. of the embodiment.

As shown in FIG. 3, the print controller 23 has a timer 230 built-in. This timer 230 is a circuit for giving a delay of specified time (wait time) to the detection timing of voltage (below-mentioned alternate current input voltage Vacin) by the below-mentioned input voltage detection circuit 265 inside the low voltage power supply part 26. Besides, time delay (addition of the wait time) of this timer 230 will be explained in details below (FIG. 9).

(Low Voltage Power Supply Part 26)

Also, as shown in FIG. 3, the low voltage power supply part 26 has a power factor correction circuit 261, a DC-AC inverter 262, a DC-DC converter 263, an electrolytic capacitor 264, and input voltage detection circuit 265, and switches SW1*a*, SW1*b*, SW2, and SW3. Besides, in this FIG. 3 the switches SW1*a*, SW1*b*, SW2, and SW3 are schematically show for convenience of explanation, and the same is true in the following drawings as well.

The power factor correction (PFC) circuit 261 is a circuit (voltage conversion circuit) that generates a direct current voltage Vdc1 based on an input voltage (an alternate current input voltage Vacin as a commercial voltage in this example) supplied from the exterior (a commercial power supply 8 in this example). The alternate current input voltage Vacin is an alternate current voltage of about 100 to 230 V for example, and the direct current voltage Vdc1 is a direct current voltage of about 390 V for example. Besides, this power factor correction circuit 261 corresponds to a specific example of the "first voltage conversion part" in this invention, the alternate current input voltage Vacin corresponds to a specific example of the "external input voltage" in this invention, and the direct current voltage Vdc1 corresponds to a specific example of the "first voltage" in this invention.

The DC-AC inverter 262 is a circuit (voltage conversion circuit) that generates alternate current voltages Vac2*a* and Vac2*b* for individually supplying power to the halogen heaters 150*a* and 150*b* inside the above-mentioned fuser 15, respectively, based on the direct current voltage Vdc1 output from the power factor correction circuit 261. Besides, as shown in FIG. 3, the generated alternate current voltage Vac2*a* is utilized for supplying power to the halogen heater 150*a*, and the alternate current voltage Vac2*b* is utilized for supplying power to the halogen heater 150*b*. As shown in FIG. 3, such DC-AC inverter 262 has a switching part 262*a* including one or multiple switching elements and a switching controller 262*b* that controls the ON/OFF operation of each of the switching elements in this switching part 262*a*. Besides, the control of the ON/OFF operation at this time is performed, for example, using pulse width modulation (PWM). Here, this DC-AC inverter 262 corresponds to a specific example of the "second voltage conversion part" in this invention, and each of the alternate current voltages Vac2*a* and Vac2*b* corresponds to a specific example of the "second voltage" in this invention.

The DC-DC converter 263 is a circuit (voltage conversion circuit) that generates two types of direct current voltages Vdc3H and Vdc3L in this example based on the direct current voltage Vdc1 output from the power factor correction circuit 261 and is a step-down DC-DC converter in this example. The direct current voltage Vdc3H is a direct current voltage of about 24 V for example and is supplied to various types of driving mechanisms (the hopping motor 251, the resist motor 252, the belt motor 253, the fuser heater motor 254, the drum motor 255, and the dew condensation prevention dehumidifying heater 256) shown in FIG. 2. On the other hand, the direct current voltage Vdc3L is a direct current voltage of about 5 V for example, and as shown in FIG. 3, is utilized as a logic voltage in various types of logic circuits (the print controller 23 etc.) for example. Also, these direct current voltages Vdc3H and Vdc3L are, as shown in FIG. 3 in this example, also supplied to the switching controller 262*b* inside the DC-AC inverter 262, and the direct current voltage Vdc3H is also supplied to the power factor correction circuit 261. Such a DC-DC converter as this is constituted of a generic self-exciting flyback converter, comprising a switching element, transformer, etc. Besides, this DC-DC converter 263 corresponds to a specific example of the "third voltage conversion part" in this invention, and the direct current voltage Vdc3H corresponds to a specific example of the "third voltage" (voltage used in driving one or multiple heaters) in this invention.

The electrolytic capacitor 264 is, as shown in FIG. 3, electrically connected to the path between the power factor correction circuit 261, and the DC-AC inverter 262 and the DC-DC converter 263 (in this example, disposed on the above-mentioned path). Specifically, in this example, it is inserted between the path between the output terminal of the power factor correction circuit 261 and a connection point P1 (the connection point of the input terminal of the DC-AC inverter 262 and the input terminal of the DC-DC converter 263) (the output path of the direct current voltage Vdc1) and the ground. Although the details will be explained below, this electrolytic capacitor 264 is a capacitor for taking measures when the alternate current input voltage Vacin has dropped (come into the below-mentioned state of instantaneous drop or instantaneous interruption). Besides, this electrolytic capacitor 264 corresponds to a specific example of the "capacitative element" in this invention.

The input voltage detection circuit 265 is a circuit (voltage detection part) that detects the alternate current input voltage Vacin at any time and is configured of a generic voltage detection circuit using a current transformer etc. for example. The detection result signal of the alternate current input voltage Vacin in this input voltage detection circuit 265 is, as shown in FIG. 3, output to the above-mentioned timer 230 inside the print controller 23. Also, by the switch control signal S3 output from the input voltage detection circuit 263 based on the detection result, the ON/OFF operation of the switch SW3 explained below is controlled at any time.

As shown in FIG. 3, the switch SW1*a* is disposed on the path between the output terminal of the switching part 262*a* inside the DC-AC inverter 262 and the halogen heater 150*a* (on the output path of the alternate current voltage Vac2*a*). On the other hand, as shown in FIG. 3, the switch SW1*b* is disposed on the path between the output terminal of the switching part 262*a* inside the DC-AC inverter 262 and the halogen heater 150*b* (on the output path of the alternate current voltage Vac2*b*). These switches SW1*a* and SW1*b* have their ON/OFF operations individually controlled by the switch control signals S1*a* and S1*b*, respectively, supplied from the print controller 23 based on the detection results (detection result signals) in the above-mentioned input voltage detection circuit 265. That is, as shown in FIG. 3, the switch SW1*a* has its ON/OFF operation controlled by the switch control signal S1*a*, and the switch SW1*b* has its ON/OFF operation controlled by the switch control signal S1*b*. Such switches SW1*a* and SW1*b* as these are each configured of switch elements such as MOS-FED (Metal-Oxide-Semiconductor Field Effect Transistor) for example. Besides, each these switches SW1*a* and SW1*b* corresponds to a specific example of the "first switch" in this invention.

The switch SW2 is disposed on the output path of the direct current voltage Vdc3H from the DC-DC converter. Besides, in this example, there is no switch provided on the output path of the direct current voltage Vdc3L from the DC-DC converter 263. As shown in FIG. 3, this switch SW2 has its ON/OFF operation controlled by the switch control signal S2 supplied from the print controller 23 based on the detection result (detection result signal) in the above-mentioned input voltage detection circuit 265. Such switch SW2 as this is also controlled by a switch element such as MOS-FET for example. Besides, such switch SW2 corresponds to a specific example of the "second switch" in this invention.

As shown in FIG. 3, the switch SW3 is disposed on the path between the output terminal of the power factor correction circuit 261 and the input terminal of the DC-AC inverter 262. Specifically, in this example, it is disposed on the output path of the direct current voltage Vdc1 between the above-mentioned connection point P1 and the DC-AC inverter (on the supply path of the direct current voltage Vdc1 to the DC-AC inverter 262). As mentioned above, this switch SW3 has its ON/OFF operation controlled at any time by the switch control signal S3 output from the input voltage detection circuit 265. Such SW3 is also configured of a switch element such as MOS-FET for example. Besides, this switch SW3 corresponds to a specific example of the "third switch" in this invention.

(Operation Stop Control by the Print Controller 23 and Input Voltage Detection Circuit 265)

Here, this embodiment has a function to perform an operation stop control of the halogen heaters 150*a* and 150*b*, an operation stop control of the DC-AC inverter 262, etc. if the above-mentioned print controller 23 and input voltage detection circuit 265 satisfy specified conditions. At this time, as mentioned above, the print controller 23 and the input voltage detection circuit 265 performs such operation stop control by utilizing the individual ON/OFF operation control to each of the switches SW1*a*, SW1*b*, SW2, and SW3.

Specifically, when the alternate current input voltage Vacin has dropped below a specified threshold voltage Vth1 mentioned below (when Vacin≤Vth1 is satisfied: the instantaneous drop mentioned below), the print controller 23 performs an operation stop control that stops the operation of at least one of the halogen heaters 150*a* and 150*b* inside the fuser 15. At this time, the print controller 23 performs such operation stop control to the halogen heaters 150*a* and 150*b* by setting at least one of the switches SW1*a*, SW1*b*, and SW2 inside the low voltage power supply part 26 to the OFF state.

Also, when the alternate current input voltage Vacin has dropped below a threshold voltage Vth2 (≤Vth1) that is lower than the above-mentioned threshold voltage Vth1 (when Vacin≤Vth2 is satisfied: the instantaneous drop mentioned below), the input voltage detection circuit 265 further performs a control to stop the operation of the DC-AC inverter (operation to generate alternate current voltages Vac2*a* and Vac2*b*). At this time, the input voltage detection circuit 265 performs such operation stop control to the DC-AC inverter 262 by setting the switch SW3 inside the low voltage power supply part 26 to the OFF state.

Furthermore, after performing such operation stop control to the halogen heaters 150*a* and 150*b* and operation stop control to the DC-AC inverter 262, if the alternate current input voltage Vacin has recovered to become higher than the threshold voltage Vth1 or the threshold voltage Vth2, the print controller 23 and the input voltage detection circuit 265 perform a control to release their operation stop controls. By this, the operations of the halogen heaters 150*a* and 150*b* and the DC-AC inverter 262 are restored. Also, at this time the print controller 26 and the input voltage detection circuit 265 release such operation stop controls by appropriately setting the switches SW1*a*, SW1*b*, SW2, and SW3 to the ON state. Besides, the details of such control operations by the print controller 23 and the input voltage detection circuit 265 (control process at the time of instantaneous drop and instantaneous interruption) will be explained below (FIG. 8-FIG. 19).

Actions and Effects

A. Basic Operations of the Whole Image Forming Apparatus 1

In this image forming apparatus 1, an image (image layer) is formed to a recording medium in the following manner. In other words, once a print job is supplied to the print controller 23 via the communication line etc. from the above-mentioned host device as shown in FIG. 2, the print controller 23 executes a print process so that the individual members inside the image forming apparatus 1 perform the following actions based on this print job.

That is, as shown in FIG. 1, the recording device contained in the sheet cassette 121 is first separated and extracted one by one from the top by the hopping roller 122 and fed toward the registration rollers 131*a* and 131*b*. Next, after having its obliqueness corrected by the registration rollers 131*a* and 131*b*, the recording medium fed from the hopping roller 122 is carried to the transfer belt 141 side. While the recording medium carried in this manner is being carried along the carrying direction d by the transfer belt 141, toner images formed in the image forming parts 11C, 11M, 11Y, and 11K in the following manner are sequentially transferred onto the recording medium along this carrying direction d.

Here, in these image forming parts 11C, 11M, 11Y, and 11K, toner images of respective colors are formed by the following electrophotographic process.

That is, first the photosensitive drum 111 has its surface (surface layer portion) uniformly charged by the charging roller 122 having a charging voltage supplied from the high voltage generator 24. Next, by emitting irradiation light from the exposure head 117 toward the surface of this photosensitive drum 111 for an exposure, an electrostatic latent image according to the print pattern prescribed by the above-mentioned print job is formed on the photosensitive drum 111.

On the other hand, the supply roller 114 having a charging voltage supplied from the high voltage generator 24 contacts with the development roller 113 also having a charging voltage supplied from the high voltage generator 24, and each the supply roller 114 and the development roller 113 rotates at a specified circumferential velocity. By this, toner is supplied from the supply roller 114 to the surface of the development roller 113.

Subsequently, toner on the development roller 113 is charged by friction etc. with a toner regulatory member (not shown) in contact with this development roller 113. Here, the thickness of the toner layer on the development roller 113 is determined by the charging voltage to the development roller 113, the charging voltage to the supply roller 114, the pressing force of the toner regulatory member (charging voltage to the above-mentioned toner regulatory member), etc.

Also, because the development roller 113 is in contact with the photosensitive drum 111, by the high voltage generator 24 supplying the charging voltage to this development roller 113, toner adheres from the development roller 113 to the electrostatic latent image on the photosensitive drum 111.

Afterwards, the toner (toner image) is transferred onto the recording medium by an electric field between it and the transfer roller 115. Besides, toner remaining on the surface of this photosensitive drum 111 is removed by being scraped off by the cleaning blade 116 and contained in the transfer belt cleaner container 143.

In this manner, toner images of individual colors are formed in the respective image forming parts 11C, 11M, 11Y, and 11K and sequentially transferred onto the recording medium along the above-mentioned carrying direction d.

Specifically, as shown in FIG. 1, in each of the image forming parts 11C, 11M, 11Y, and 11K, toner of corresponding color (cyan toner, magenta toner, yellow toner, or black toner) is used to form a layer (image layer) constituted of the toner of each color.

Subsequently, as shown in FIG. 1, toner on the recording medium carried from the transfer belt 141 is fused by heat and pressure given by the fuser 15. Specifically, the fusing operation is performed by giving heat and pressure to the recording medium being carried in the carrying direction d while it is sandwiched by a nip part (not shown) formed between the fuser belt (not shown) and the pressure roller (not shown) for example.

Then, the recording medium with the fusing operation performed is ejected to the exterior of the image forming apparatus 1 (onto the ejection tray 162 in this example) via the sheet guide 161. By the above, the image forming operation in the image forming apparatus 1 becomes complete.

B. Basic Operation of the Low Voltage Power Supply Part

Also, in such image forming operation as this, the low voltage power supply part 26 shown in FIG. 2 and FIG. 3 operates in the following manner.

That is, first, once the alternate current input voltage Vacin is supplied from the commercial power supply 8, the power factor correction circuit 261 generates the direct current voltage Vdc1 based on this alternate current input voltage Vacin. Next, based on the direct current voltage Vdc1 generated in this manner, the DC-AC inverter 262 generates the alternate current voltages Vac2*a* and Vac2*b*. Then, by these alternate current voltages Vac2*a* and Vac2*b* being supplied, the halogen heaters 150*a* and 150*b* inside the fuser 15 perform the above-mentioned heating operation in the fusing operation.

On the other hand, the DC-DC converter 263 generates two types of direct current voltages Vdc3H and Vdc3L based on the above-mentioned direct current voltage Vdc1. The direct current voltage Vdc3H (about 24 V for example) generated in this manner is supplied to various types of driving mechanisms (the hopping motor 251, the resist motor 252, the belt motor 253, the fuser heater motor 254, the drum motor 255, and the dew condensation prevention dehumidifying heater 256) shown in FIG. 2. On this other hand, as shown in FIG. 3, the direct current voltage Vdc3L (about 5 V for example) is utilized as a logic voltage in various types of logic circuits (the print controller 23 etc.) for example. Besides, as shown in FIG. 3, these direct current voltages Vdc3H and Vdc3L are also supplied to the switching controller 262*b* inside the DC-AC inverter 262. Also, the direct current voltage Vdc3H is supplied to the power factor correction circuit 261 as well.

Also, at this time in the input voltage detection circuit 265, the alternate current input voltage Vacin input to the low voltage power supply part 26 is detected at any time. Then, as shown in FIG. 3, this detection result signal of the alternate current voltage Vacin in the input voltage detection circuit 265 is supplied to the timer 230 inside the print controller 23 and utilized for controlling the ON/OFF operations of the switches SW1*a*, SW1*b*, and SW2 explained below in details. Also, by the switch control signal S3 output from the input voltage detection circuit 265 based on the detection result of the alternate current voltage Vacin, the ON/OFF operation of the switch SW3 explained below in details is controlled at any time.

C. Control Process at the Time of Instantaneous Drop or Instantaneous Interruption Incidentally, the alternate current input voltage Vacin input to the low voltage power supply part 26 in this manner could drop in some cases as follows for example.

Figure 5A:
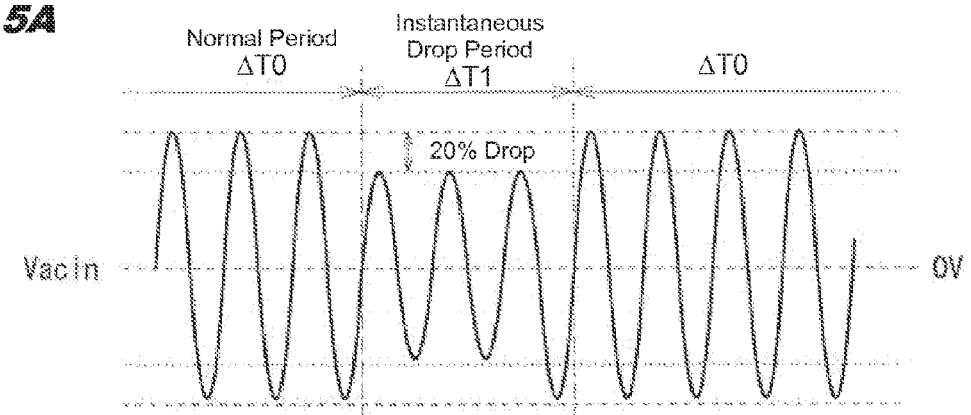
FIGS. 5A and 5B are timing waveform charts expressing an example of external input voltage drop (instantaneous drop).
Figure 5B:
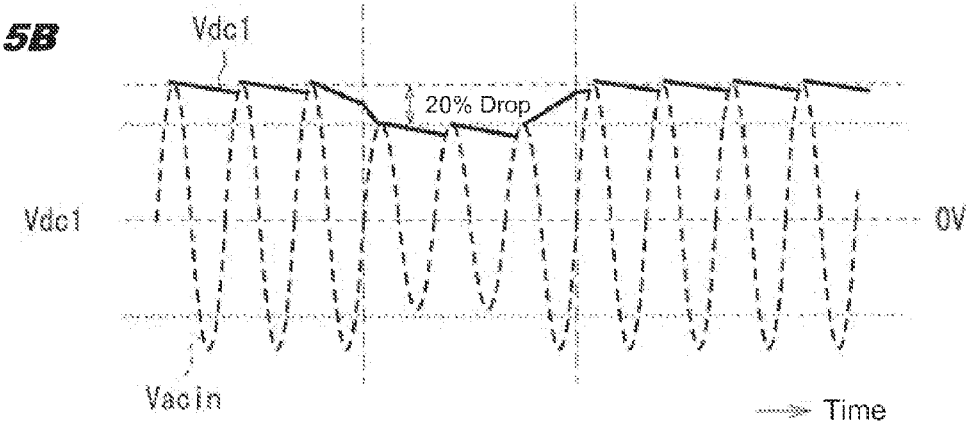

That is, as shown in FIG. 5A for example, this alternate current input voltage Vacin could drop somewhat (by about 20% in this example) relative to the value during the normal period ΔT0 as the reference (100%) in some cases. In such a case, as shown in FIG. 5B for example, the direct current voltage Vdc1 generated by the power factor correction circuit 261 based on this alternate current input voltage Vacin also drops by about 20% in this example. This kind of some drop in the alternate current input voltage Vacin (drop below the threshold voltage Vth1 mentioned below) is hereafter be called the state of "instantaneous drop", and as shown in FIGS. 5A and 5B, the period of this state of instantaneous drop is hereafter defined as the instantaneous drop period ΔT1.

Figure 6A:
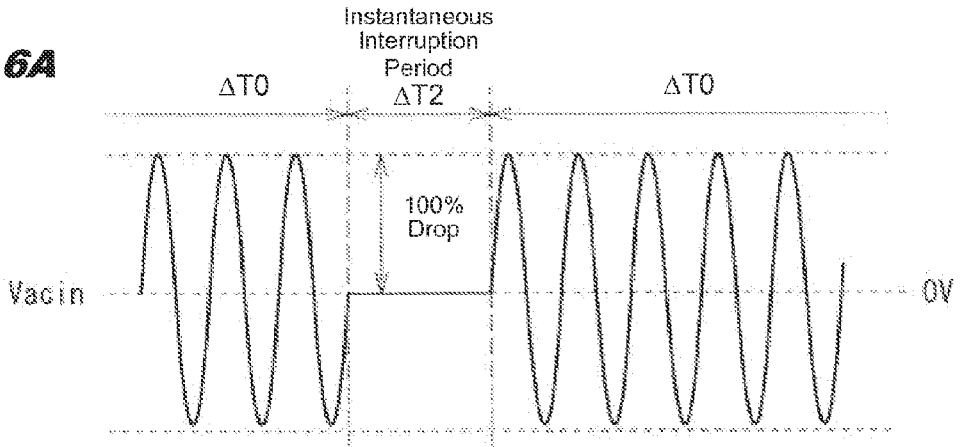
FIGS. 6A and 6B are timing waveform charts expressing another example of external input voltage drop (instantaneous interruption).
Figure 6B:
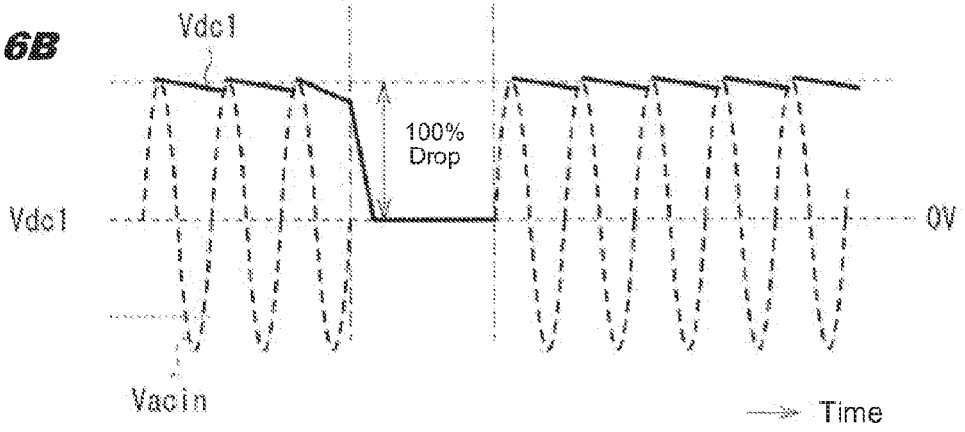

Also, as shown in FIG. 6A for example, this alternate current input voltage Vacin could further drop extremely (by about 100% in this example) relative to the value at ΔT0 as the reference (100%) (become nearly 0 V) in some cases. In that case, as shown in FIG. 6B for example, the direct current voltage Vdc1 generated by the power factor correction circuit 261 based on this alternate current input voltage Vacin also drops by about 100% in this example. This kind of further drop in the alternate current input voltage Vacin (drop below the threshold voltage Vth2 mentioned below) is hereafter called the state of "instantaneous interruption", and as shown in FIGS. 6A and 6B, the period of this state of instantaneous interruption is hereafter defined as the instantaneous interruption period ΔT2.

Comparative Example

Figure 7:
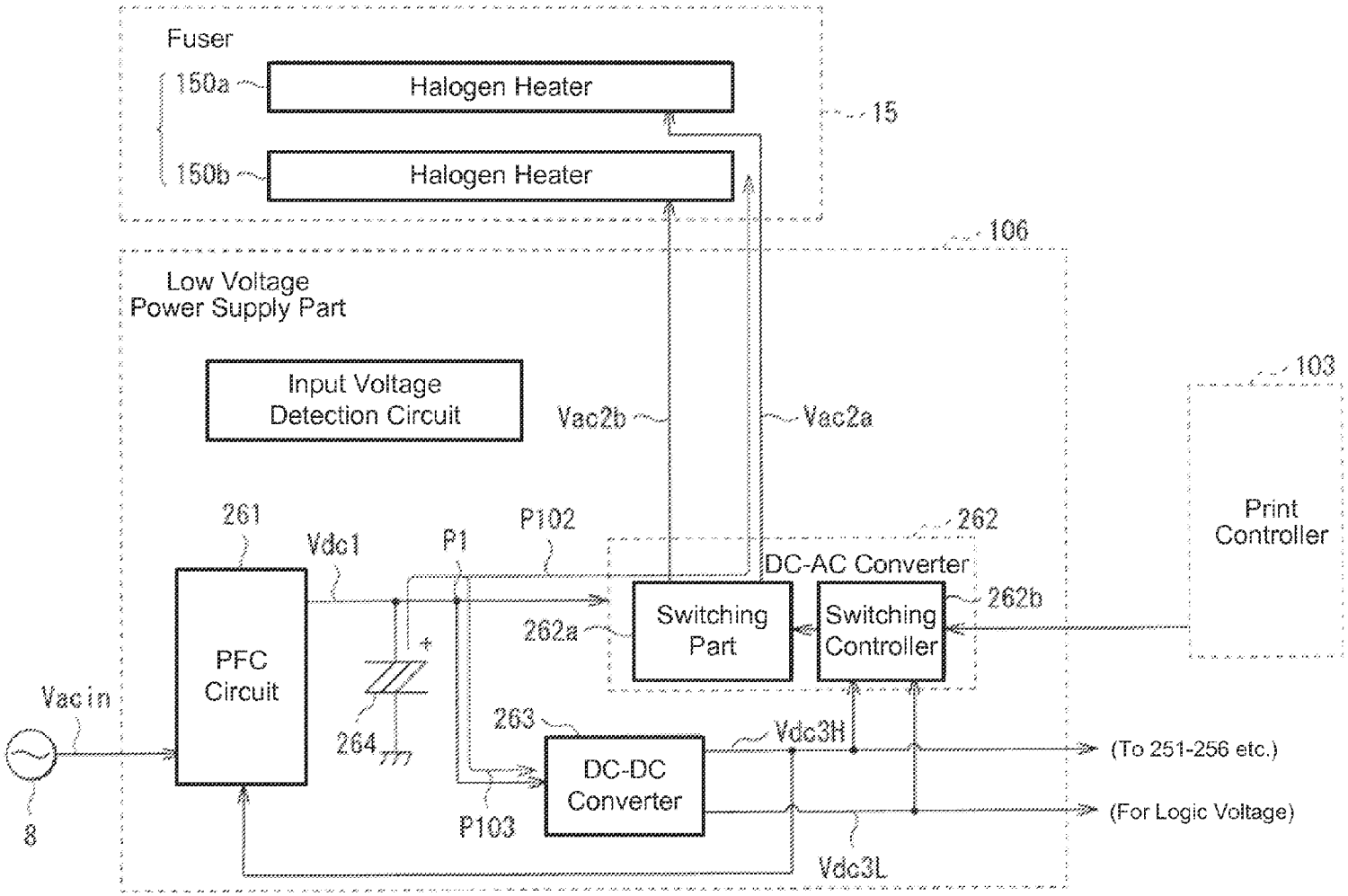
FIG. 7 is a circuit diagram expressing a heater and its control mechanism of a comparative example.

When in such state of instantaneous drop or state of instantaneous interruption, the following operation state occurs in the low voltage power supply part 106 and the print controller 103 of the comparative example shown in FIG. 7 for example. Here, the low voltage power supply part 106 of this comparative example corresponds to the one having the input voltage detection circuit 265 and the switches SW1*a*, SW1*b*, SW2, and SW3 unprovided (omitted) in the low voltage power supply part 26 of this embodiment. Therefore, in the print controller 103 of this comparative example, unlike the print controller 23 etc. of this embodiment, the ON/OFF operations of such switches SW1*a*, SW1*b*, SW2, and SW3 as these are not controlled.

By such a configuration as this, in the comparative example, when the above-mentioned alternate current input voltage Vacin has dropped (in the state of instantaneous drop or instantaneous interruption), as shown with arrows P102 and P103 in FIG. 7, operation maintenance utilizing the charge stored in the electrolytic capacitor 264 inside the low voltage power supply part 106 is performed. That is, by utilizing the charge stored in this electrolytic capacitor 264, both the power supply to the halogen heaters 150*a* and 150*b* and the operation of the DC-DC converter 263 are performed. Therefore, in this comparative example, for the time of a drop in the alternate current input voltage Vacin (at the time of instantaneous drop or instantaneous interruption), there arises a need to store the charge for both the power supply to the halogen heaters 150*a* and 150*b* and the operation of the DC-DC converter 263 in the electrolytic capacitor 264. Therefore, because it is necessary to store the charge for supplying power to the halogen heaters 150*a* and 150*b* having large consumed power, a large-capacity electrolytic capacitor becomes necessary in the low voltage power supply part 106 of this comparative example.

In this manner, in the comparative example, as a result of the increase in the capacity of the electrolytic capacitor 264, the mounting area of the electrolytic capacitor 264 and the parts cost of the electrolytic capacitor increase among others. In addition, because the halogen heaters 150*a* and 150*b* having large consumed power are always operating, power saving of the image forming apparatus as the whole also becomes difficult.

This Embodiment

Then, in the image forming apparatus 1 of this embodiment, as explained in details below, in the print controller 23 and the input voltage detection circuit 265, when the alternate current input voltage Vacin has dropped below the threshold voltage Vth1, the operation stop control that stops the operation of at least one of the halogen heaters 150*a* and 150*b* is performed.

By performing such operation stop control, in this embodiment, unlike the above-mentioned comparative example, the following actions are obtained. That is, there will be no need to store the charge for both the power supply to the halogen heaters 150*a* and 150*b* and the operation of the DC-DC converter 263 in the electrolytic capacitor 264 as in the above-mentioned comparative example for the time of a drop in the alternate current input voltage Vacin (at the time of instantaneous drop or instantaneous interruption). That is, it will be only necessary to store the charge for the operation of the DC-DC converter 263, and it will become unnecessary to store the charge for supplying power to the halogen heaters 150*a* and 150*b*, which occupies the major portion.

D. Specific Control Process

Subsequently, referring to FIG. 8-FIG. 19, a more detailed explanation will be given on the specific control process by the print controller 23 and the input voltage detection circuit 265 at the time of such instantaneous drop or instantaneous interruption.

Figure 8:
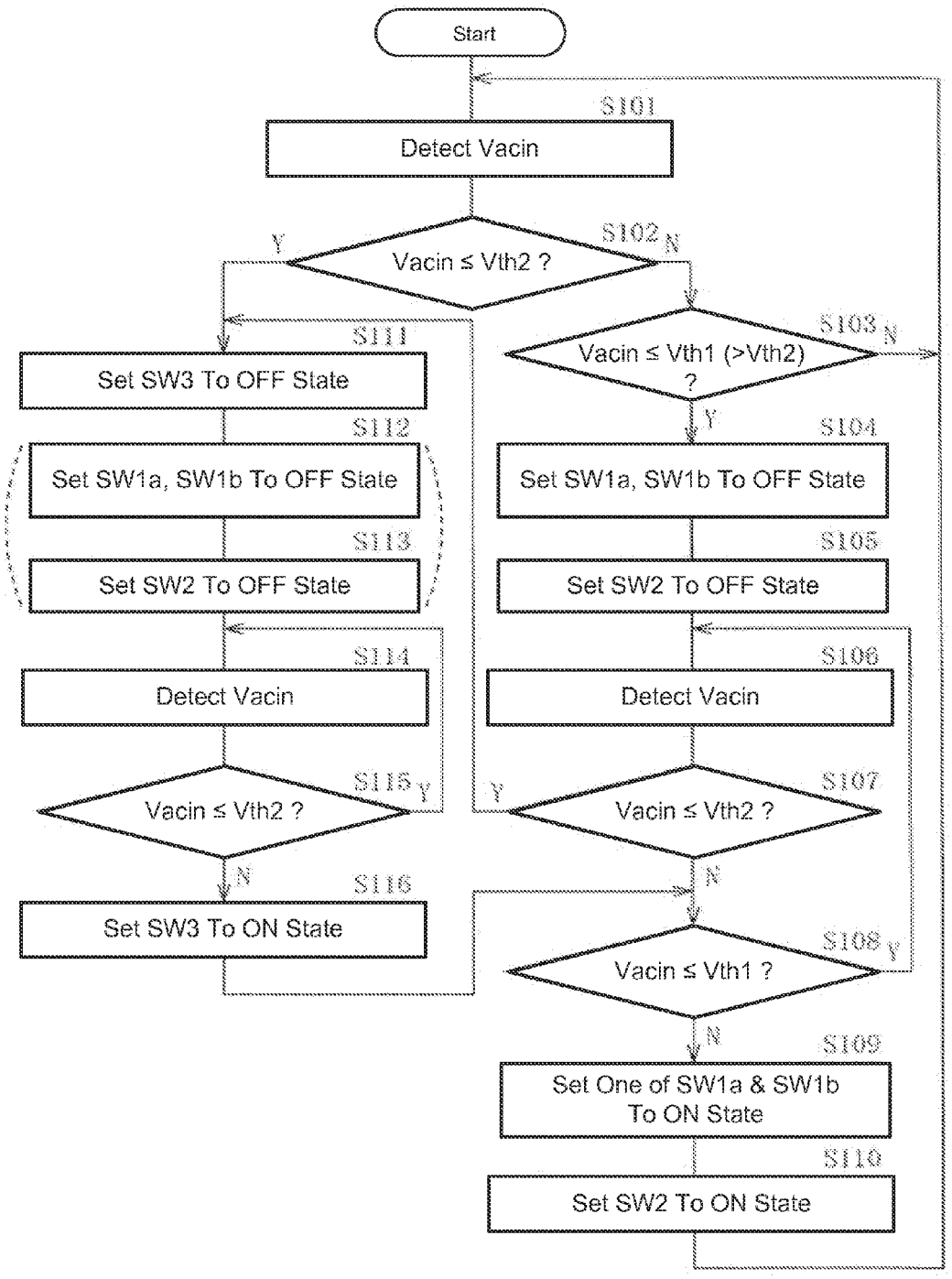
FIG. 8 is a flow chart expressing an example of the control operation of the heater etc. of the embodiment.

Shown in FIG. 8 is a flow chart expressing an example of such control process of this embodiment. Also, FIG. 9 is a timing waveform chart expressing an example of the control process shown in FIG. 8.

In FIG. 9, (A) shows the voltage of the alternate current input voltage Vacin (expressed as a percentage), (B) the state (ON/OFF state) of the switch SW3, and (C) the voltage of the direct current voltage Vdc1, respectively. Also, (D) shows the state of the switch SW1*a*, (E) the operation state of the halogen heater 150*a*, (F) the state of the switch SW1*b*, and (G) the operation state of the halogen heater 150*b*, respectively. Also, (H) shows the state of the switch SW2, and (I) the voltage of the direct current voltage Vdc3H, respectively.

Besides, in FIG. 9, the threshold voltage Vth1 is a threshold value indicating the boundary whether the alternate current input voltage Vacin is in the normal state or the state of instantaneous drop and is set to about 80% value relative to the alternate current input voltage Vacin value during the normal period ΔT0 as the reference (100%) in this example. Also, the threshold voltage Vth2 is a threshold value indicating the boundary whether the alternate current input voltage Vacin is in the state of instantaneous drop state or the state of instantaneous interruption and is set to about 20% value relative to the alternate current input voltage Vacin value during the normal period ΔT0 as the reference (100%) in this example. That is, the threshold voltage Vth1>the threshold voltage Vth2. Besides, each of these threshold voltage Vth1 and Vth2 values can be arbitrarily changed (adjusted) in the design stage for example. Also, the threshold voltage Vth1 corresponds to a specific example of the "first threshold" in this invention, and the threshold voltage Vth2 corresponds to a specific example of the "second threshold" in this invention.

Also, FIG. 10-FIG. 19 are schematic circuit diagrams expressing an example of the operation state of the low voltage power supply part 26 and the halogen heaters 150*a* and 150*b* during the control operation shown in FIG. 8 and FIG. 9. Besides, in these FIG. 10-FIG. 19, a block entirely surrounded with a broken line and shown as a blank inside schematically indicates that its operation is in the stop state. Also, in FIG. 10-FIG. 19, a portion crossed out with an "x" schematically indicates that power supply (supply of the direct current voltage Vdc3H in this example) to that block is stopped.

(Judgment process of instantaneous interruption and instantaneous stop) In this control process, first, the alternate current input voltage Vacin is detected in the input voltage detection circuit 265 (step S101 in FIG. 8). Then, the input voltage detection circuit 265 judges whether the detected alternate current input voltage Vacin is below the above-mentioned threshold voltage Vth2 (whether Vacin≤Vth2 is satisfied or not) (step S102). That is, the input voltage detection circuit 265 judges whether this alternate current input voltage Vacin is in the above-mentioned state of instantaneous interruption. Here, if it is judged that the alternate current input voltage Vacin is below the threshold voltage Vth2 (Vacin≤Vth2 is satisfied), that is, corresponding to the state of instantaneous interruption (step S102: Y), it proceeds to the below-mentioned operation stop control at the time of instantaneous interruption (steps S111-S113).

On the other hand, if the alternate current input voltage Vacin is not below the threshold voltage Vth2 (Vacin≤Vth2 is not satisfied), that is, it does not correspond to the state of instantaneous interruption (step S102: N), next the print controller 23 judges whether this alternate current input voltage Vacin is in the above-mentioned state of instantaneous drop or not. Specifically, the print controller 23 judges whether this alternate current input voltage Vacin is below the above-mentioned threshold voltage Vth1 or not (whether Vacin≤Vth1 (>Vth2) is satisfied or not) (step S103). Here, if it is judged that the alternate current input voltage Vacin is not below the threshold voltage Vth1 (not even Vacin≤Vth1 is satisfied), that is, not even corresponding to the state of instantaneous drop (step S103: N), it is judged to be in the normal period ΔT0 and returns to the first Step S101.

(Operation stop control at the time of instantaneous drop) On the other hand, if it is judged that the alternate current input voltage Vacin is below the threshold voltage Vth1 (Vth2<Vacin≤Vth1 is satisfied), that is, corresponding to the state of instantaneous drop (step S103: Y, see the instantaneous drop period ΔT1 of the timing t1-t2 in FIG. 9), the following occurs. That is, next the print controller 23 performs the operation stop control at the time of instantaneous drop explained below (steps S104 and S105).

Specifically, the print controller 23 performs the operation stop control that stops the operation of at least one (one kind) of the two (two types of) halogen heaters 150*a* and 150*b* inside the fuser 15. More specifically, the print controller 23 first sets at least one of the switches SW1*a* and SW1*b* inside the low voltage power supply part 26 to the OFF state, thereby performing such operation stop control of the halogen heaters 150*a* and 150*b* (step S104).

Also, if both at least one of the switches SW and SW1*b* and the switch SW2 are in the ON state, the print controller 23 subsequently sets these switches SW1*a* and SW1*b* and the switch SW2 to the OFF state in a specified order, thereby performing such operation stop control. Specifically, as mentioned above, the print controller 23 sets the switches SW1*a* and SW1*b* to the OFF state earlier than the switch SW2 (in the order of the switches SW1*a* and SW1*b*→the switch SW2) in this example (step S105: see times Δt1, Δt3, and Δt5 in FIG. 9). However, if there is no particular problem in controlling carrying the recording medium etc. for example, the switches SW1*a* and SW1*b* and the switch SW2 may be simultaneously set to the OFF state (for example, time Δt1=time Δt3=time Δt5 in FIG. 9).

Figure 10:
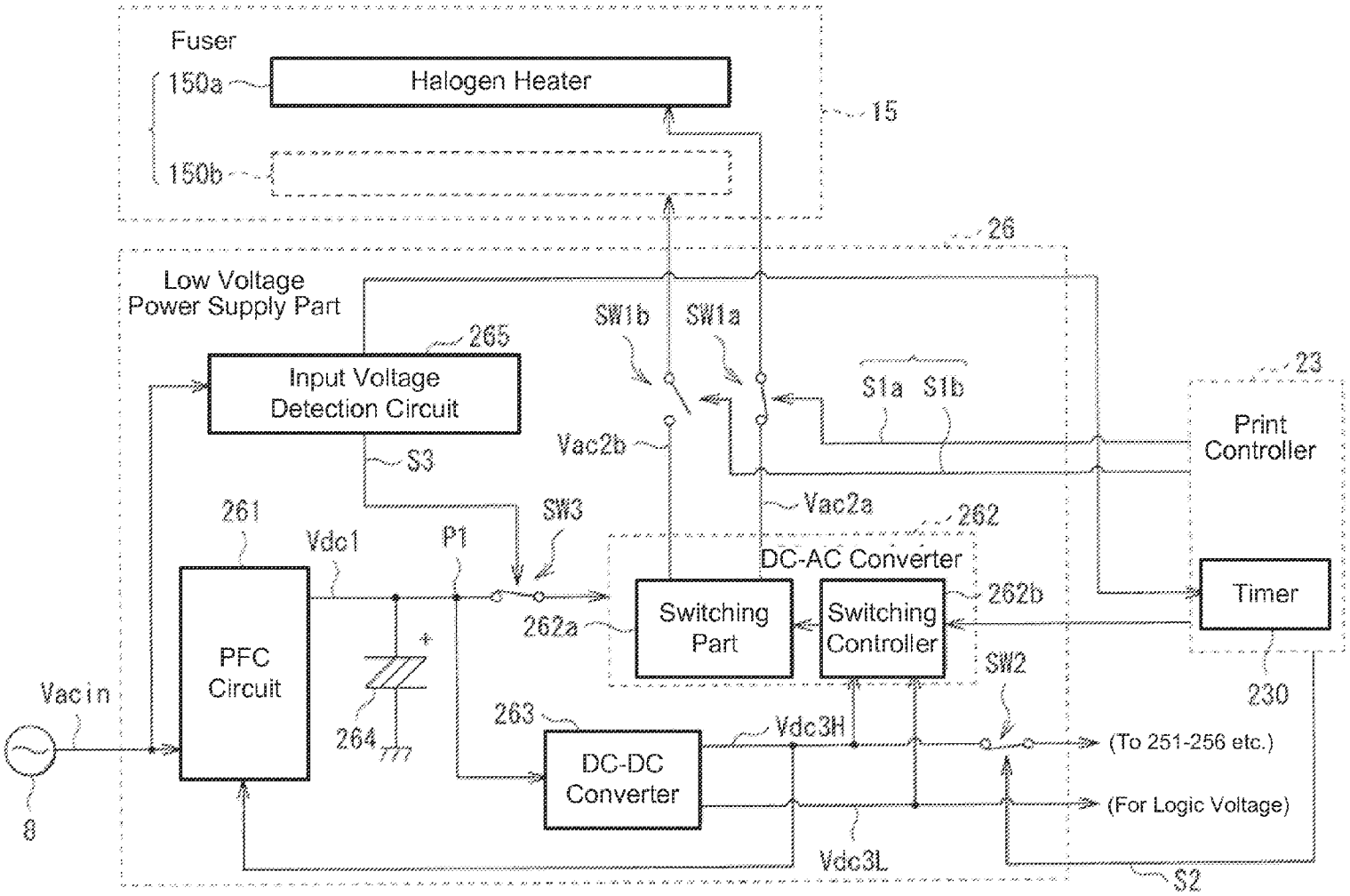
FIG. 10 is a schematic circuit diagram expressing an example of the operation state of the control operation shown in FIG. 8 and FIG. 9.

Here, as shown in FIG. 10 for example, if the switch SW1*a* is in the ON state and the switch SW1*b* the OFF state (if the halogen heater 150*a* is in the operation state and the halogen heater 150*b* is in the operation stop state), the print controller 23 performs the operation stop control in the following manner. That is, first, as indicated with a broken-line arrow in FIG. 11 for example, by setting the switch SW1*a* in the ON state to the OFF state, each of the switches SW1*a* and SW1*b* is set to the OFF state.

Figure 11:
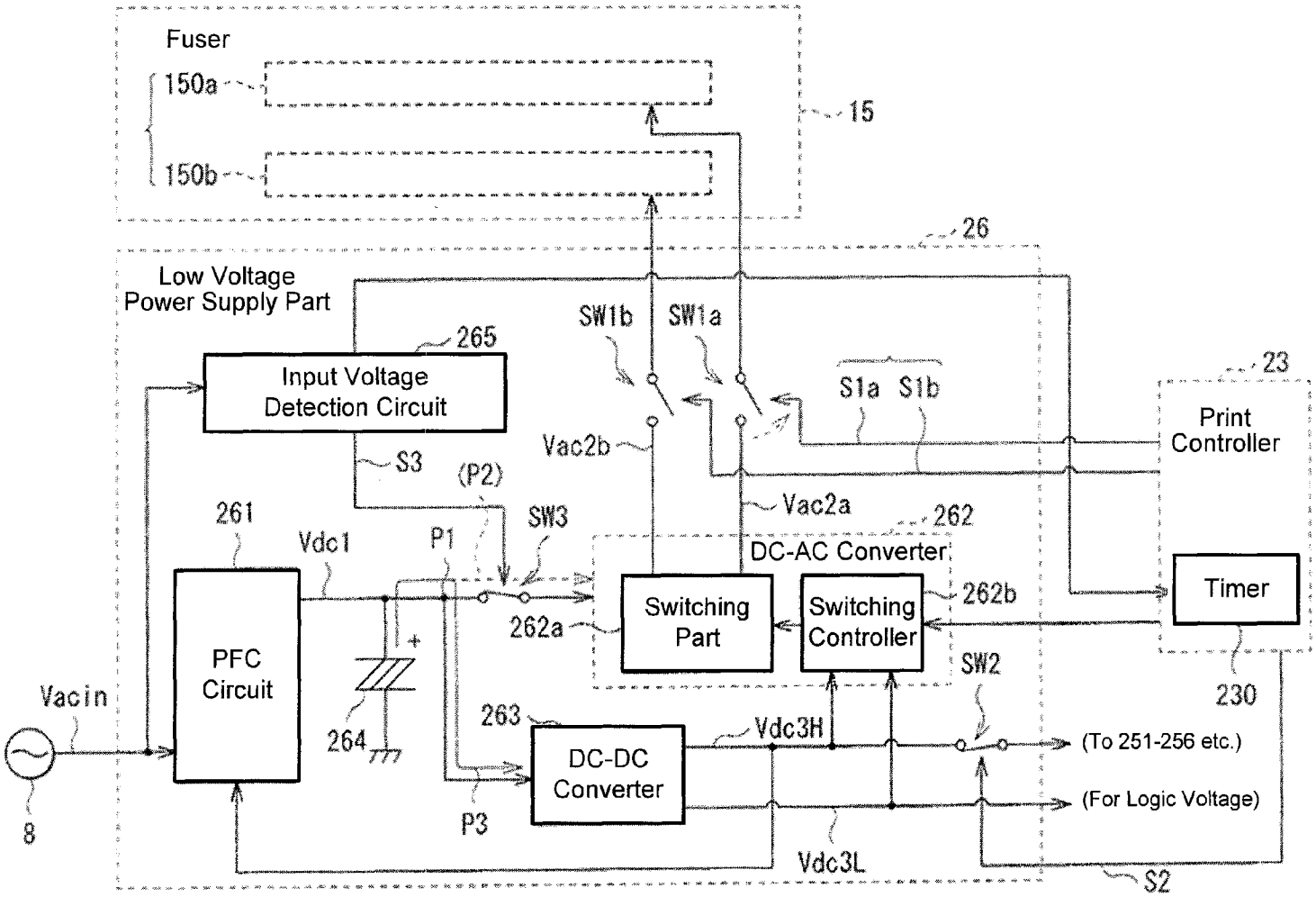
FIG. 11 is a schematic circuit diagram expressing another example of the operation state of the control operation shown in FIG. 8 and FIG. 9.

By this, as shown in FIG. 11, both the halogen heater 150*a* and 150*b* come into the operation stop state. As a result, as shown with arrows P2 and P3 in FIG. 11, at the time of the drop (instantaneous drop) of this alternate current input voltage Vacin, while the stored charge is supplied to the DC-DC converter 263 from the electrolytic capacitor 264, the charge supplies to the halogen heaters 150*a* and 150*b* stop. That is, although the charge for operating and maintaining the DC-AC inverter 262 is supplied (see the arrow P2), charges are not supplied to the halogen heaters 150*a* or 150*b* that came into the operation stop state. Therefore, there is no longer a need to store the charges for both supplying power to the halogen heaters 150*a* and 150*b* and operating the DC-DC converter 263 in the electrolytic capacitor 264 as in the above-mentioned comparative example. That is, it becomes only necessary to store the charge for the operation of the DC-DC converter 263 (somewhat also necessary for operating the DC-AC inverter in this example), and it becomes unnecessary to store the charge for supplying power to the halogen heaters 150*a* and 150*b*, which occupies the major portion. As a result, the electrolytic capacitor 254 only needs a smaller capacity in this embodiment than that in the above-mentioned comparative example.

Figure 12:
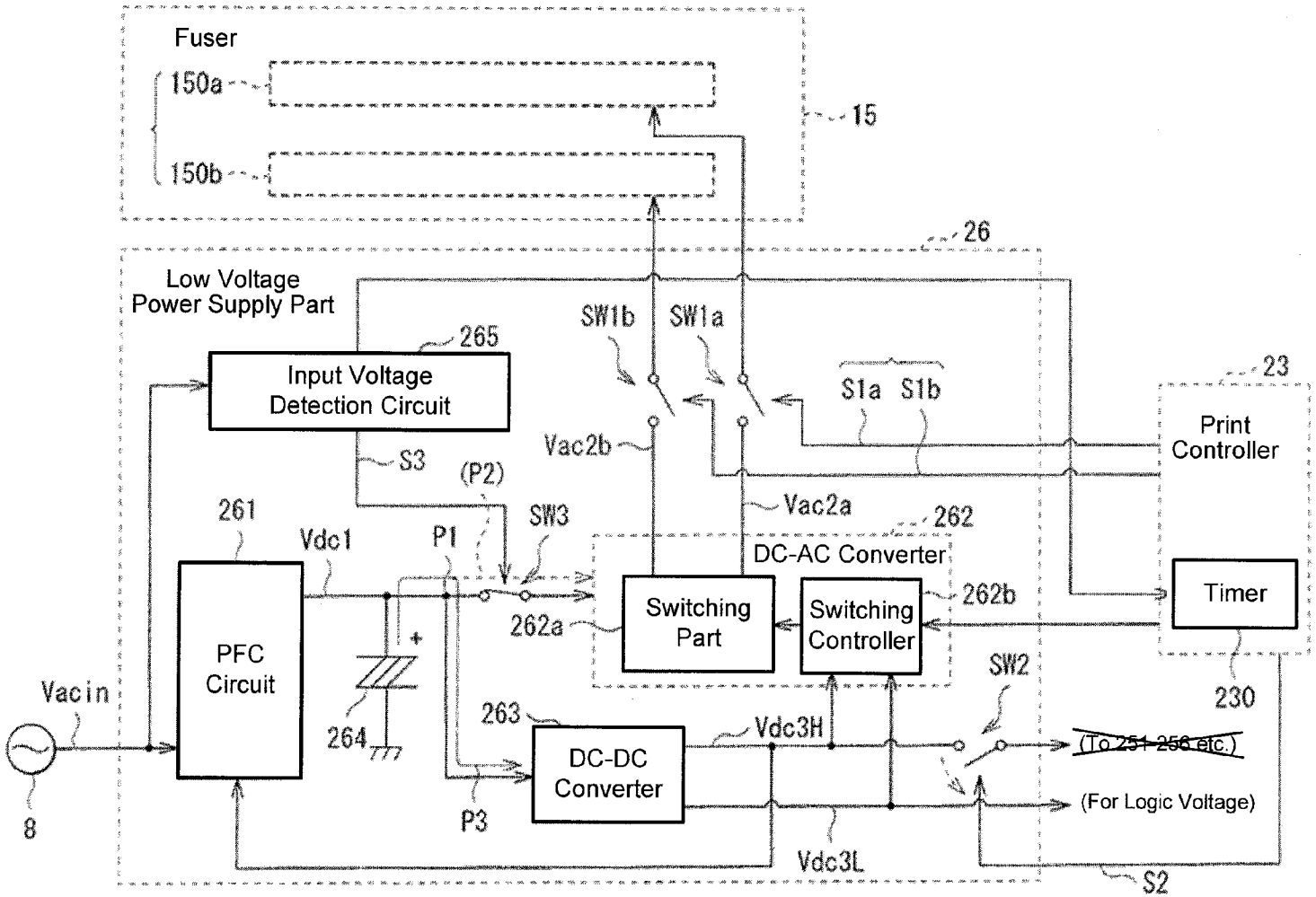
FIG. 12 is a schematic circuit diagram expressing another example of the operation state of the control operation shown in FIG. 8 and FIG. 9.

Then, in this example, as indicated with a broken-line arrow in FIG. 12, the print controller 23 sets the switch SW2 to the OFF state. This stops the supply of the direct current voltage Vdc3H to the above-mentioned various types of driving mechanisms (the hopping motor 251, the resist motor 252, the belt motor 253, the fuser heater motor 254, the drum motor 255, and the dew condensation prevention dehumidifying heater 256). Therefore, the operations of the driving mechanisms such as the fuser heater motor 253 and the dew condensation prevention dehumidifying heater 256 for driving the halogen heaters 150*a* and 150*b* are also stopped, thereby contributing to the consumed power reduction in the image forming apparatus 1 as the whole.

Figure 13:
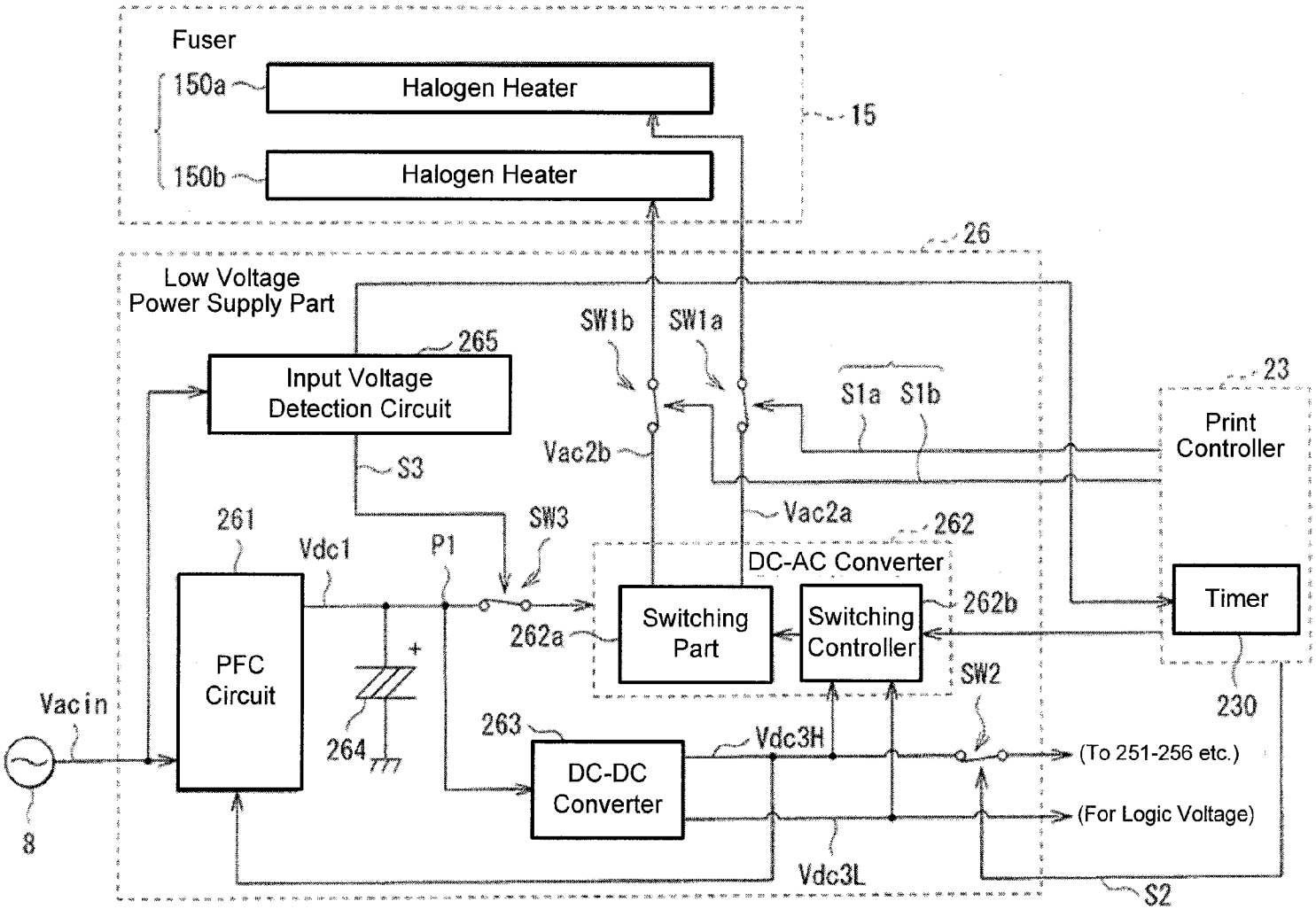
FIG. 13 is a schematic circuit diagram expressing another example of the operation state of the control operation shown in FIG. 8 and FIG. 9.
Figure 14:
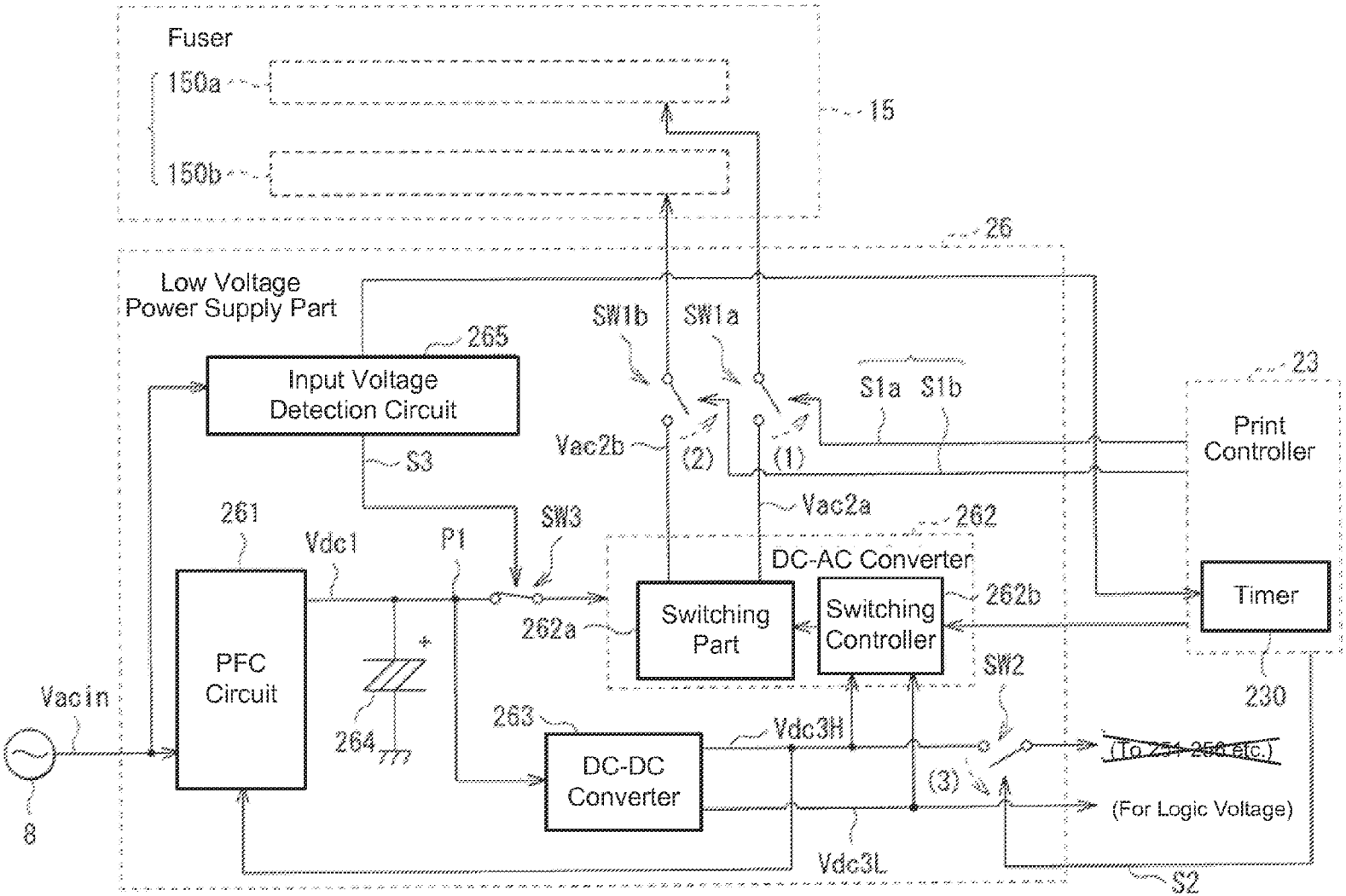
FIG. 14 is a schematic circuit diagram expressing another example of the operation state of the control operation shown in FIG. 8 and FIG. 9.

Also, here as shown in FIG. 13 for example, if both the switches SW1*a* and SW1*b* are in the ON state (both the halogen heaters 150*a* and 150*b* are in the operation state) as in the heating operation of the fuser 15 in the initial operation, the print controller 23 performs the operation stop control in the following manner. That is, in the same manner as in the above-mentioned example, the print controller 23 sets the switches to the OFF state in the order of SW1*a* and SW1*b*→SW2 (see the order indicated with (1)→(2)→(3) in FIG. 14; hereafter indicated in the same manner). By this, in the same manner as in the above-mentioned example, the electrolytic capacitor 254 comes to require only a small capacity, and the consumed power in the image forming apparatus 1 as the whole is reduced.

At this time, as shown in this example, the print controller 23 preferentially stops the operation of a halogen heater (the halogen heater 150*a* in this example) having relatively large consumed power among the two types of halogen heaters 150*a* and 150*b* for example. That is, in this example, the print controller 23 sets the switches to the OFF state in the order of SW1*a*→SW1*b* so that the operation of the halogen heaters will stop in the order of 150*a*→150*b* (see FIG. 14 and FIG. 9 (D)-FIG. 9 (G)). By this, the operation of the halogen heater having relatively large consumed power is preferentially stopped, thereby contributing to further reduction of the consumed power of the image forming apparatus 1 as the whole.

Also, at this time, once the alternate current input voltage Vacin has become below the threshold voltage Vth1 (entered the state of instantaneous drop: from the timing t1 in FIG. 9) for example, after a specified wait time (see the times Δt1, Δt3, and Δt5 in FIG. 9 for example) has passed, the print controller 23 sets these switches SW1*a*, SW1*b*, and SW2 to the OFF state. Setting this wait time is realized by the timer 230 inside the print controller 23 for example. By setting such wait times, timing adjustment with the controls of carrying the recording medium etc. can be arbitrarily set. Besides, each of these times Δt1, Δt3, and Δt5 corresponds to a specific example of the "first period" in this invention.

(Judgment process of recovery from the time of instantaneous drop) Subsequently, after the operation stop control at the time of instantaneous drop (steps S104 and S105) was performed, next the print controller 23 performs the judgment process of recovery from the instantaneous drop explained below.

That is, first the alternate current input voltage Vacin is detected again in the input voltage detection circuit 265 (step S106). Then, the input voltage detection circuit 265 first judges whether the detected alternate current input voltage Vacin is below the threshold voltage Vth2 or not again (step S107). That is, the input voltage detection circuit 265 judges whether the alternate current input voltage Vacin has changed over from the state of instantaneous drop to the state of instantaneous interruption or not (see the timing t2 in FIG. 9 for example). Here, if it is judged that the alternate current input voltage Vacin is below the threshold voltage Vth2, that is, having changed over to the state of instantaneous interruption (step S107: Y), the system proceeds to the operation stop control at the time of instantaneous interruption (steps S111-S113) mentioned below.

On the other hand, if it is judged that the alternate current input voltage Vacin is not below the threshold voltage Vth2, that is, not having changed over to the state of instantaneous interruption (step S107: N), next the print controller 23 judges whether this alternate current input voltage Vacin is still in the state of instantaneous drop or not. Specifically, the print controller 23 judges whether this alternate current input voltage Vacin is below the threshold voltage Vth1 or not (step S108). Here, if it is judged that the alternate current input voltage Vacin is below the threshold voltage Vth1, that is, still corresponding to the state of instantaneous drop (step S108: Y), the system returns to Step S106 again.

(Operation restoration control from the time of instantaneous drop) On the other hand, if it is judged that the alternate current input voltage Vacin is not below the threshold voltage Vth1, that is, not corresponding to the state of instantaneous drop and having recovered to the normal period ΔT0 (step S108: N, see the normal period ΔT0 after the timing t4 in FIG. 9), the following occurs. That is, next the print controller 23 performs an operation restoration control from the time of instantaneous drop, in other words a control to release the operation stop control at the time of instantaneous drop (steps S109 and S110) explained below.

Specifically, the print controller 23 performs a control to restore the operation of at least one (one kind) of the two (two types of) halogen heaters 150*a* and 150*b* inside the fuser 15. More specifically, the print controller 23 sets at least one of the switches SW1*a* and SW1*b* inside the low voltage power supply part 26 to the ON state, thereby releasing the operation stop controls of the halogen heaters 150*a* and 150*b* (step S109).

Figure 15:
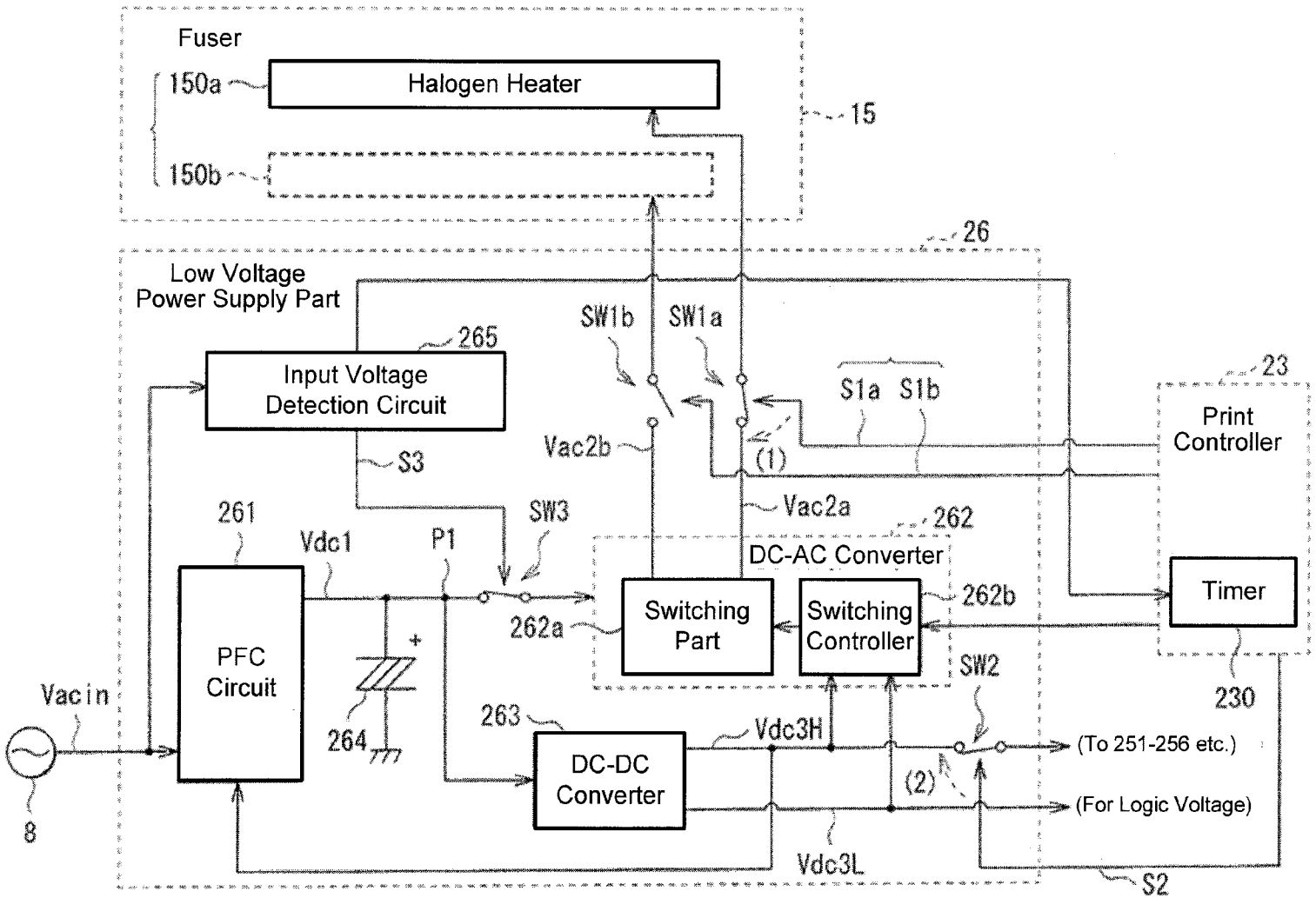
FIG. 15 is a schematic circuit diagram expressing another example of the operation state of the control operation shown in FIG. 8 and FIG. 9.
Figure 16:
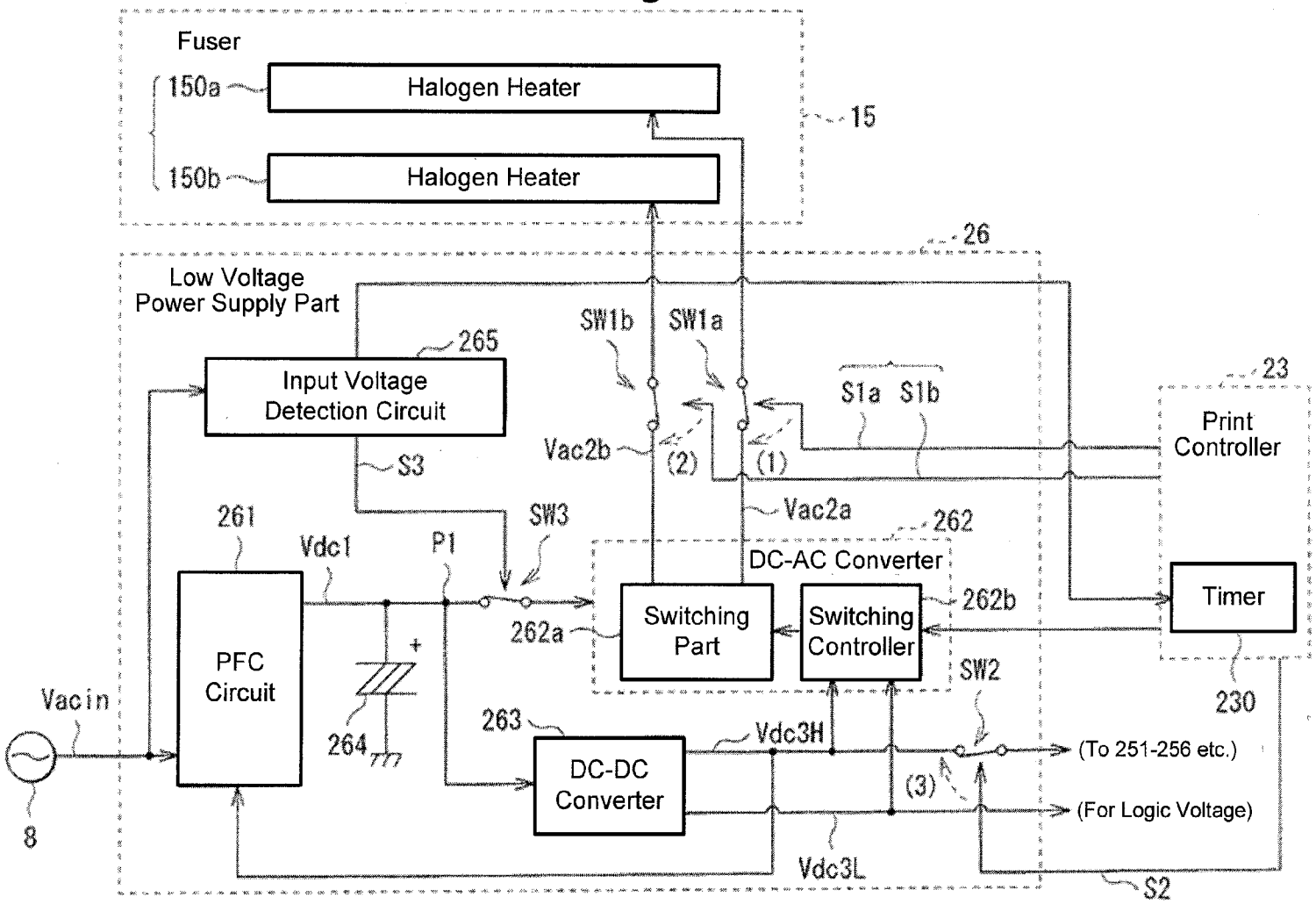
FIG. 16 is a schematic circuit diagram expressing another example of the operation state of the control operation shown in FIG. 8 and FIG. 9.

Also, if both the switches SW1*a* and SW1*b* and the switch SW2 are in the OFF state, the print controller 23 subsequently sets these switches SW1*a* and SW1*b* and the switch SW2 to the ON state in a specified order, thereby performing such release of the operation stop controls. Specifically, as shown in FIG. 15 and FIG. 16 for example, the print controller 23 sets the switches SW1*a* and SW1*b* to the ON state earlier than the switch SW2 (in the order of the switches SW1*a* and SW1*b*→the switch SW2) (step S110: see the times Δt2, Δt4, and Δt6 in FIG. 9). By this, carrying the recording medium is resumed after the operation of the fuser 15 is restored (after it is heated), realizing a more preferable control. However, if there is no particular problem in controlling carrying the recording medium etc. for example, the switches SW1*a* and SW1*b* and the switch SW2 may be simultaneously set to the ON state (for example, the time Δt2=the time Δt4=the time Δt6 in FIG. 9).

At this time, as shown in FIG. 16 for example, if both the two types of halogen heaters 150*a* and 150*b* are in the operation stop state, the print controller 23 preferentially restores the operation of the halogen heater having relatively large consumed power among these (the halogen heater 150*a* in this example). That is, in this example, the print controller 23 sets the switches to the ON state in the order of SW1*a*→SW1*b* so that the operations of the halogen heaters are restored in the order of 150*a*→150*b* (see FIG. 16 and FIG. 9 (D)-FIG. 9 (G)). By this, the operation of the halogen heater having relatively large consumed power is preferentially restored (its operation stop is released), allowing a quicker restoration of the operation of the fuser 15.

Also, at this time, the print controller 23 sets these switches SW1*a*, SW1*b*, and SW2 to the ON state after a specified wait time (see the times Δt2, Δt4, and Δt6 in FIG. 9 for example) has passed since the alternate current input voltage Vacin has recovered (from the state of instantaneous drop) to become higher than the threshold voltage Vth1 (from the timing t3 in FIG. 9) for example. Setting this wait time is realized by the timer 230 inside the print controller 23 for example. By setting such wait time, timing adjustment with the controls of carrying the recording medium etc. can be arbitrarily set. Here, each of these times Δt2, Δt4, and Δt6 corresponds to a specific example of the "second period" in this invention. Besides, after such control to release the operation stop control at the time of instantaneous drop (steps S109 and S110) is performed (after being restored to the normal period ΔT0), the system returns to the initial step S101 again.

(Operation stop control at the time of instantaneous interruption) Here, in the above-mentioned step S102 or step S107, if it is judged that the alternate current input voltage Vacin is below the threshold voltage Vth2 (Vacin≤Vth2 is satisfied), that is, corresponding to the state of instantaneous interruption (see the instantaneous interruption period ΔT2 at the timings t2-t3 in FIG. 9), the following occurs. That is, next the input voltage detection circuit 265 performs the operation stop control at the time of instantaneous interruption (steps S111-S113) explained below.

Figure 17:
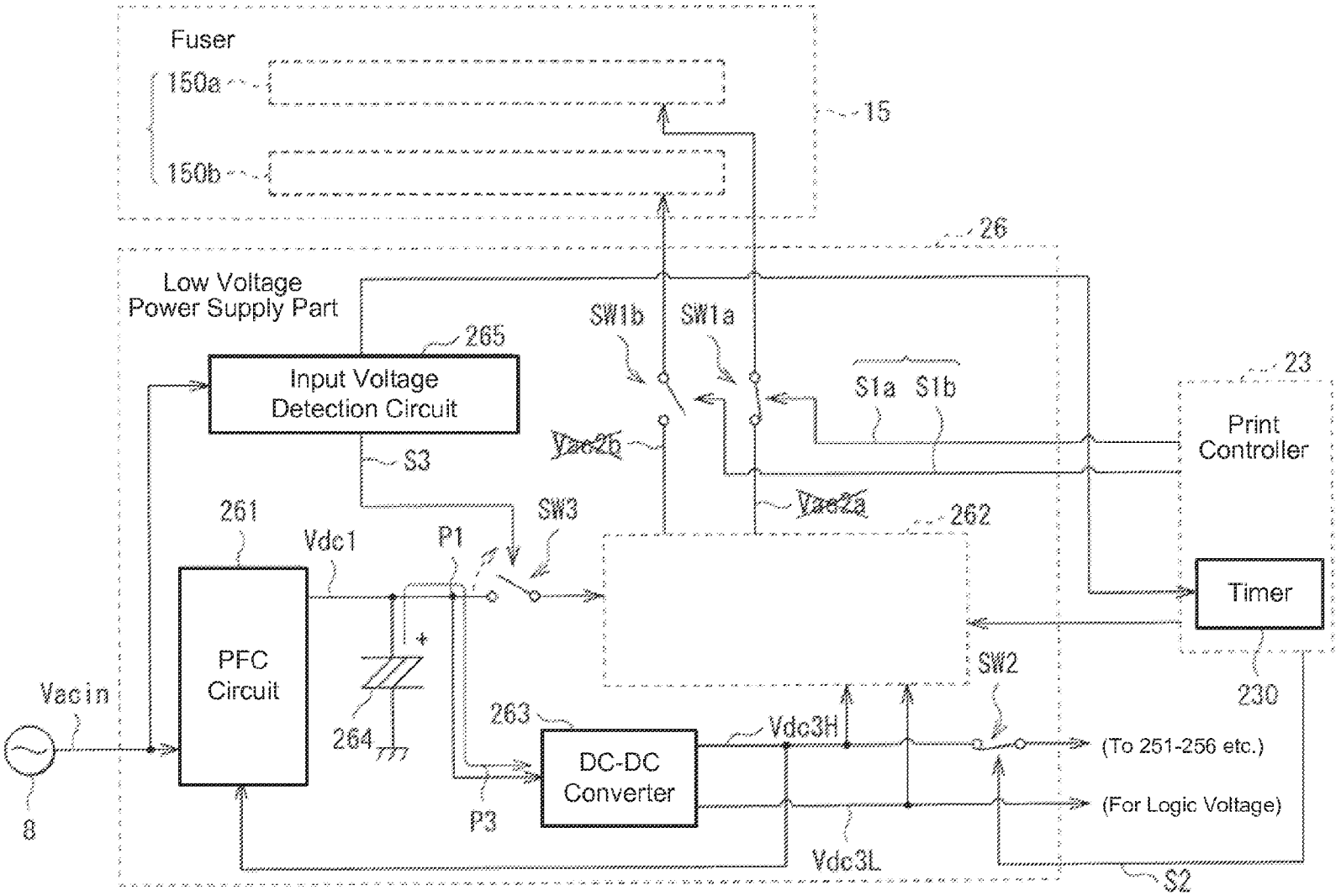
FIG. 17 is a schematic circuit diagram expressing another example of the operation state of the control operation shown in FIG. 8 and FIG. 9.

Specifically, as shown in FIG. 17 for example, the input voltage detection circuit 265 performs an operation stop control that stops the operation itself of the DC-AC inverter 262 inside the low voltage power supply part 26. More specifically, the input voltage detection circuit 265 sets the switch SW3 inside the low voltage power supply part 26 to the OFF state so that the direct current voltage Vdc1 from the power factor correction circuit 261 is not supplied to the DC-AC inverter 26, thereby performing such operation stop control of the DC-AC inverter 262 (step S111). By this, because the operation itself of the DC-AC inverter 262 also stops, as indicated with the arrow P3 in FIG. 17 for example, storing the charge for operating the DC-AC inverter 262 also becomes unnecessary (only storing the charge for operating the DC-DC converter 263 becomes necessary). As a result, the necessary capacity of the electrolytic capacitor 254 becomes even smaller.

Also, at this time, immediately after the alternate current input voltage Vacin has become below the threshold voltage Vth2 (immediately after entering the state of instantaneous interruption: see the timing t2 in FIG. 9 (B), FIG. 9 (C), and FIG. 9), the input voltage detection circuit 265 sets this switch SW3 to the OFF state to perform the operation stop control of the DC-AC inverter 262. This is for quickly taking a measure without going through the print controller 23 (the timer 230) because the state of instantaneous interruption is the worst case of the drops in the alternate current input voltage Vacin.

Figure 18:
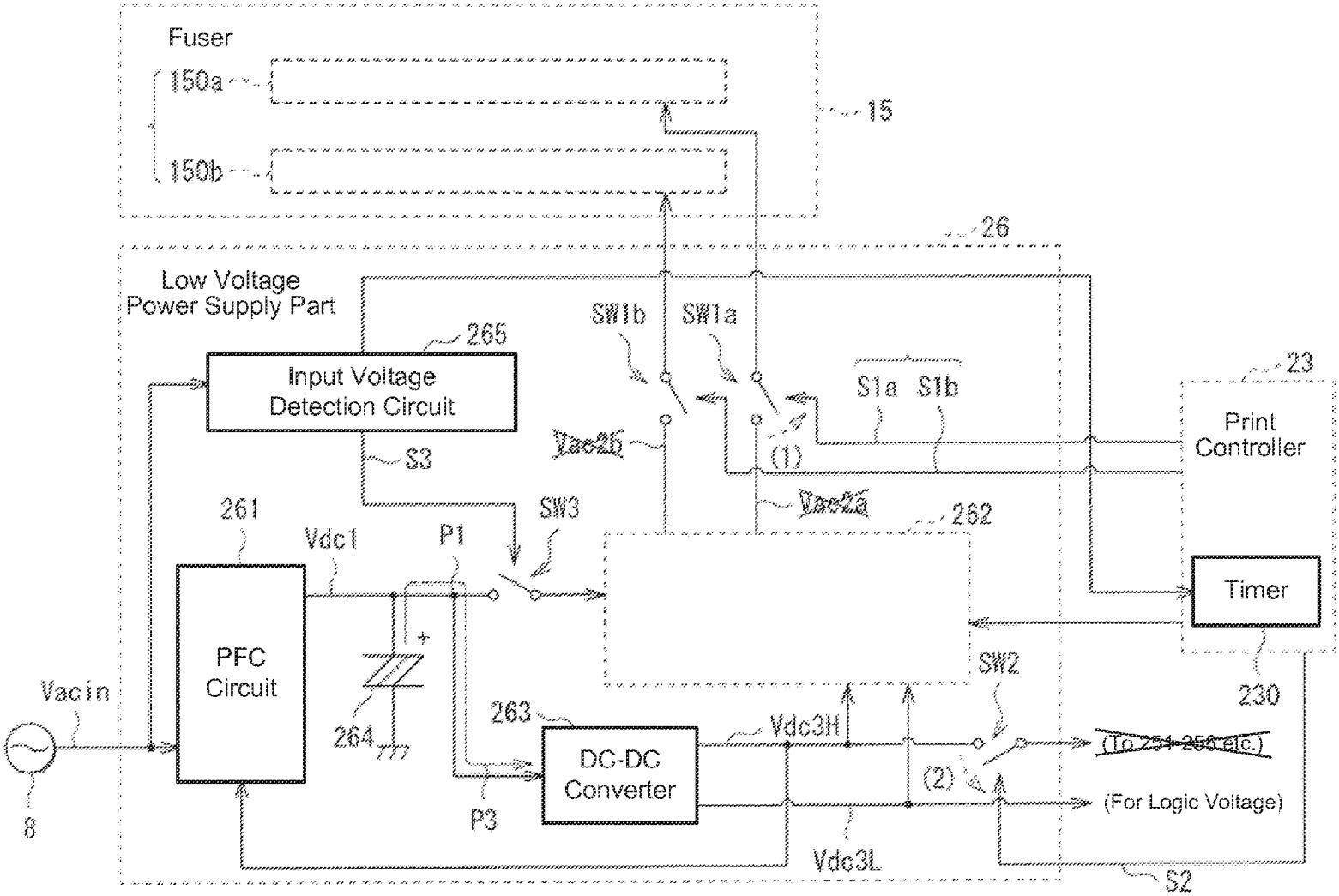
FIG. 18 is a schematic circuit diagram expressing another example of the operation state of the control operation shown in FIG. 8 and FIG. 9.

Subsequently, as shown in FIG. 18 for example, the print controller 23 sets the switches to the OFF state in the order of SW1*a* and SW1*b*→SW2 in the same manner as in the above-mentioned steps S104 and S105 (the operation stop control at the time of instantaneous drop) (steps S112 and S113). By this, as mentioned above, the operations of the halogen heaters 150*a* and 150*b* are stopped, and the supply of the direct current voltage Vdc3H to the above-mentioned various types of driving mechanisms (the hopping motor 251, the resist motor 252, the belt motor 253, the fuser heater motor 253, the drum motor 255, and the dew condensation prevention dehumidifying heater 256) is stopped. Besides, if the step S107 was gone through, these steps S112 and S113 were already performed in the steps S104 and S105, respectively, they will not be actually performed (see broken-line parentheses in FIG. 8).

(Judgment process of recovery from the time of instantaneous interruption) Subsequently, after such operation stop control at the time of instantaneous interruption (steps S111-S113) has been performed, next the print controller 23 and the input voltage detection circuit 263 perform a judgment process of recovery from the time of instantaneous drop explained below.

That is, first, the alternate current input voltage Vacin is detected again in the input voltage detection circuit 265 (step S114). Then, the input voltage detection circuit 265 judges again whether the detected alternate current input voltage Vacin is below the threshold voltage Vth2 or not (step S115). That is, the input voltage detection circuit 265 judges whether the alternate current input voltage Vacin is still in the state of instantaneous interruption or not. Here, if it is judged that the alternate current input voltage Vacin is below the threshold voltage Vth2, that is, still in the state of instantaneous interruption (step S115: Y), the system returns to S114 again.

(Operation restoration control from the time of instantaneous interruption) On the other hand, if it is judged that the alternate current input voltage Vacin is not below the threshold voltage Vth2, that is, recovered without corresponding to the state of instantaneous interruption (step S115: N, see the instantaneous drop period ΔT1 at the timings t3-t4 in FIG. 9), the following occurs. That is, next the input voltage detection circuit 265 performs an operation restoration control from the time of instantaneous interruption, in other words, a control to release the operation stop control at the time of instantaneous interruption explained below.

Figure 19:
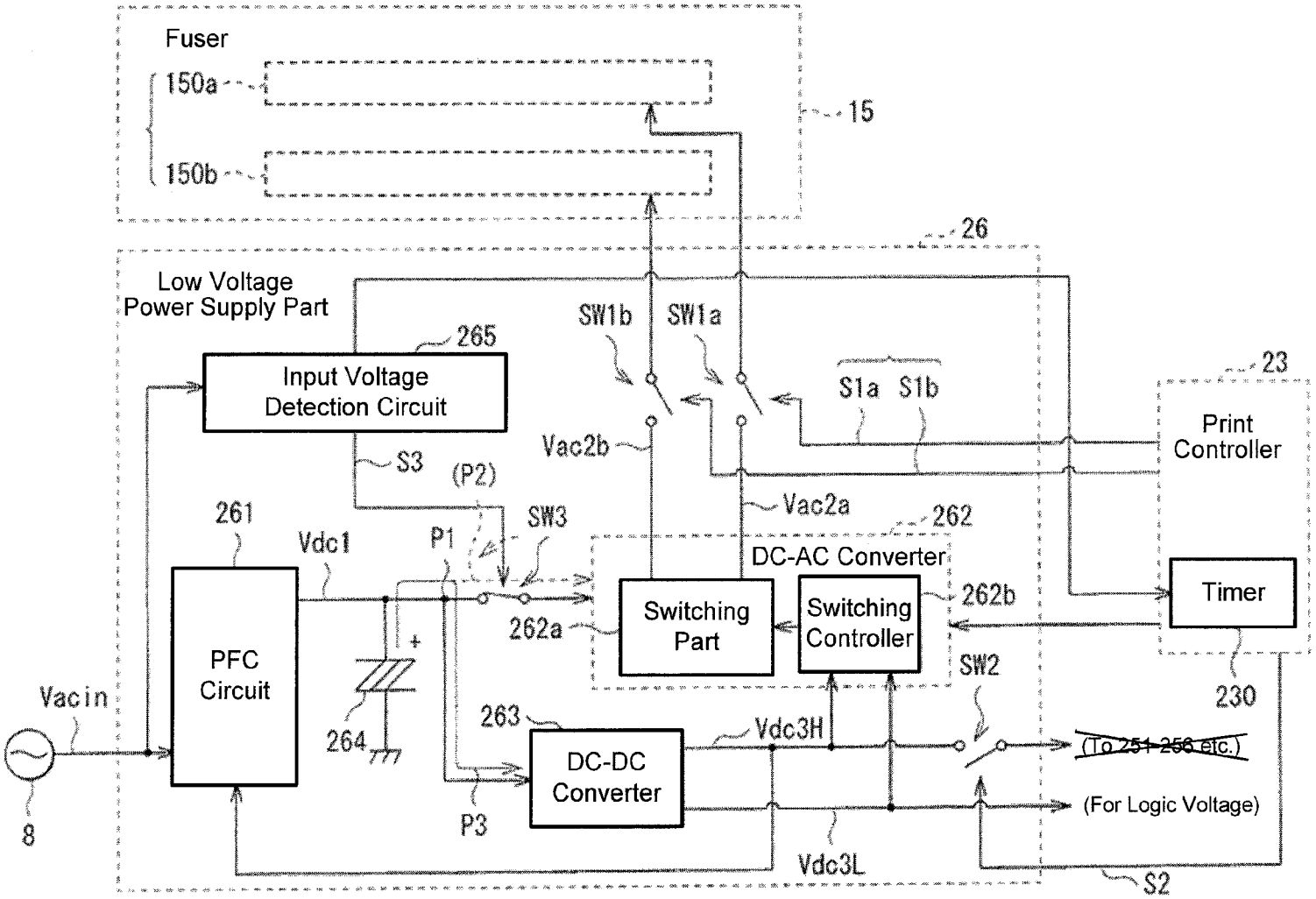
FIG. 19 is a schematic circuit diagram expressing another example of the operation state of the control operation shown in FIG. 8 and FIG. 9.

Specifically, the input voltage detection circuit 265 performs a control to restore the operation of the DC-AC inverter 262. More specifically, as shown in FIG. 19 for example, the input voltage detection circuit 265 sets the switch SW3 inside the low voltage power supply part 26 to the ON state, thereby releasing the operation stop control of the DC-AC inverter 262 (step S116).

Also, at this time, immediately after the alternate current input voltage Vacin has recovered to become higher than the threshold voltage Vth2 (immediately after recovering from the state of instantaneous interruption: see the timing t3 in FIG. 9 (B), FIG. 9 (C), and FIG. 9), the input voltage detection circuit 265 sets this switch SW3 to the ON state so that the operation of the DC-AC inverter 262 is restored. By this, as shown in FIG. 9 for example, after the time Δt0 has passed since the recovery from the state of instantaneous interruption, the operation of the DC-AC inverter 262 is restored. Besides, after such control to release the operation stop control at the time of instantaneous interruption (step S116) is performed, the system changes over to the above-mentioned step S108. In the above, a series of control processes shown in FIG. 8 and FIG. 9 ends.

As explained above, in this embodiment, in the print controller 23 and the input voltage detection circuit 265, if the alternate current input voltage Vacin drops below the threshold voltage Vth1, the operation stop control to stop the operation of at least one of the halogen heaters 150*a* and 105*b* is performed, having the following operational advantage obtained. That is, by performing such operation stop control, there will be no need to store the charge for both the power supply to the halogen heaters 150*a* and 150*b* and the operation of the DC-DC converter 263 in the electrolytic capacitor 264 for the time of a drop (at the time of instantaneous drop or instantaneous interruption) in the alternate current input voltage Vacin as in the above-mentioned comparative example. That is, it will be only necessary to store the charge for the operation of the DC-DC converter 263, and it will become unnecessary to store the charge for supplying power to the halogen heaters 150*a* and 150*b*, which occupies the major portion. Therefore, it become possible to reduce the capacity of the electrolytic capacitor 264.

Also, as a result of the reduced capacity of the electrolytic capacitor 264, it becomes possible to reduce the mounting area of the electrolytic capacitor 264, reduce the parts cost of the electrolytic capacitor 264, etc. In addition, because the operations of the halogen heaters 150*a* and 150*b* having large consumed power are stopped, it also becomes possible to achieve power saving of the image forming apparatus 1 as the whole.

2. Modifications

Although this invention was explained referring to an embodiment in the above, this invention is not limited to this embodiment, but various types of modifications are possible.

For example, although the above-mentioned embodiment was explained referring specifically to the configuration (shape, disposition, number of pieces, etc.) of each of the members in the image forming apparatus, these configurations of the individual members are not limited to those explained in the above-mentioned embodiment, but they can be other shapes, dispositions, number of pieces, etc. Also, as to the values and magnitude relations of the various types of parameters explained in the above-mentioned embodiment, they are not limited to those explained in the above-mentioned embodiment but can be controlled to other values or magnitude relations.

Specifically, for example, although the above-mentioned embodiment was explained referring to a case that the heater is a halogen heater as an example, the configuration of the heater is not limited to this but can be other configurations. That is, it can be a heater having other configurations such as a ceramic heater. Also, as to the kind and the number of the heaters are not limited to the example (two types and two pieces) explained in the above-mentioned embodiment, but they can be one kind or three or more types having different consumed power from one another, and one piece or three or more pieces.

Further, the input voltage from the exterior to the low voltage power supply part is not limited to an alternate current input voltage (commercial voltage) supplied from a commercial power supply, but the input voltage can be other external voltages (alternate current voltage or direct current voltage) for example. In addition, the voltages inside the low voltage power supply part (the direct current voltage Vdc1, the alternate current voltages Vac2*a* and Vac2*b*, and the direct current voltages Vdc3H and Vdc3L) are not limited to the category of direct current or alternate current explained in the above-mentioned embodiment but can be either.

Also, although the above-mentioned embodiment was explained referring specifically to the control processes at the time of instantaneous drop and the time of instantaneous interruption as examples, the control process in this invention is not limited to this, but other control processes can be performed.

Figure 21:
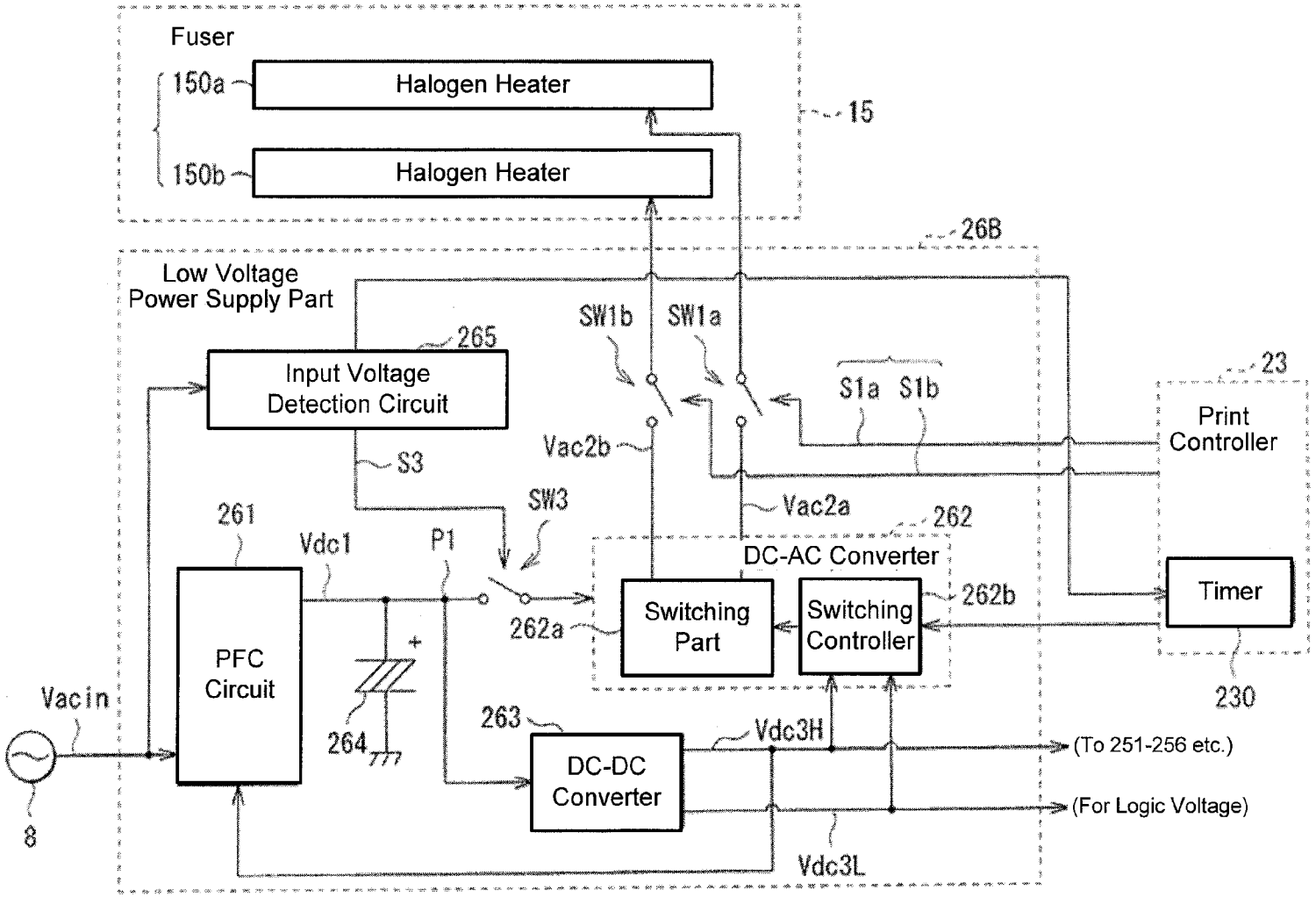
FIG. 21 is a schematic circuit diagram expressing another example of the operation state of the control operation shown in FIG. 8 and FIG. 9.
Figure 22:
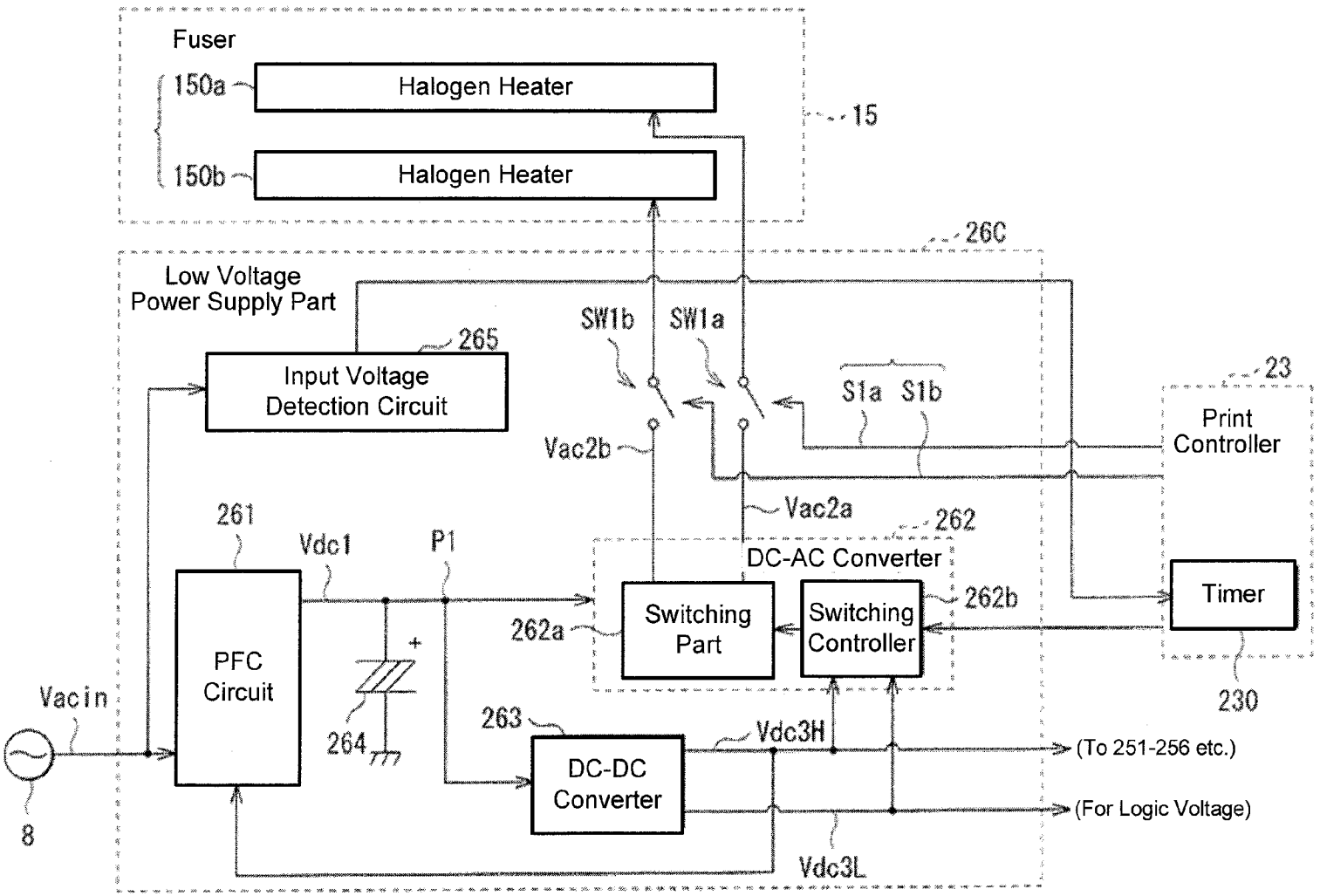
FIG. 22 is a schematic circuit diagram expressing another example of the operation state of the control operation shown in FIG. 8 and FIG. 9.

Further, the circuit configuration of the low voltage power supply part (the configuration of the individual voltage conversion parts etc.) is also not limited to the one explained in the above-mentioned embodiment, but other configurations can be adopted. Specifically, although the above-mentioned embodiment was explained referring to the case that the switches SW1*a*, SW1*b*, SW2, and SW3 are provided inside the low voltage power supply part 26 and their ON/OFF operations are individually controlled as an example, as shown in FIG. 20-FIG. 22 for example, not all switches need to be provided.

Figure 20:
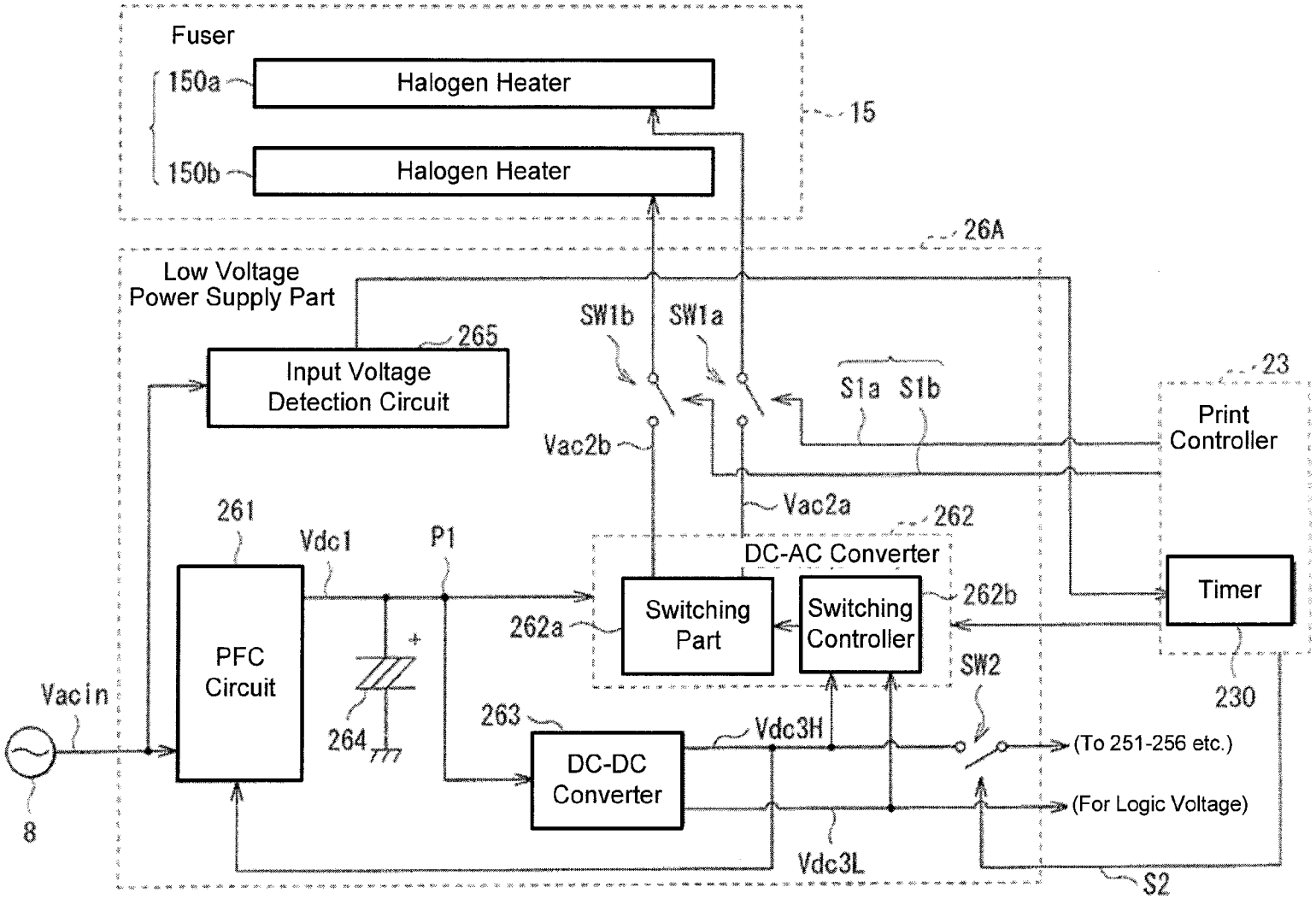
FIG. 20 is a schematic circuit diagram expressing another example of the operation state of the control operation shown in FIG. 8 and FIG. 9.

That is, as in the low voltage power supply part 26A shown in FIG. 20 for example, it can be arranged so that only the switches SW1*a*, SW1*b*, and SW2 are provided (SW3 is not provided). Alternatively, as in the low voltage power supply part 26B shown in FIG. 21 for example, it can be arranged so that only the switches SW1*a*, SW1*b*, and SW3 are provided (SW2 is not provided). Also, as in the low voltage power supply part 26C shown in FIG. 22 for example, it can be arranged so that only the switches SW1*a* and SW1*b* are provided (SW2 and SW3 are not provided).

In addition, although the above-mentioned embodiment was explained referring to the case that multiple image forming parts (for image forming parts of 11C, 11M, 11Y, and 11K) are provided as an example, but it is not limited to this. That is, the number of the image forming parts that form the image layer, the combination of toner colors used for them, etc. can be arbitrarily set according to the use and purpose. Also, depending on the circumstances, the number of the image forming parts can be set to only one, and the image layer can be made a monochromatic (single color) image. That is, the image forming apparatus can be set to function as a monochromatic printer.

Also, although the above-mentioned embodiment was explained referring to plain paper sheets as an example of the recording medium, the recording medium is not limited to this, but other media can be used. Specifically, special paper sheets such as OHP (OverHead Projector) sheets, cards, postcards, cardboards (paper weighing 250 g/m$^2$ equivalent or more for example), envelopes, coated papers having a large heat capacity can be used for example.

Further, the above-mentioned embodiment was explained referring to an image forming apparatus that functions as a printer as a specific example of the "image forming apparatus" in this invention, it not limited to this. That is, this invention can be also applied to, for example, an image forming apparatus that functions as a facsimile machine, a copier, a multifunction machine, etc.

What is claimed is:

1. A heater control device, comprising:

a first voltage conversion part that generates a first voltage based on an external input voltage that is input from an outside, a second voltage conversion part that generates a second voltage for supplying power to one or multiple heaters, which are provided inside the device, based on the first voltage, a third voltage conversion part that generates a third voltage used at least in driving the one or multiple heaters based on the first voltage, a capacitative element that is electrically connected to a path that connects the first voltage conversion part to the second voltage conversion part and connects the first voltage conversion part to the third voltage conversion part, further the capacitative element being located in a section of the path that is used for connecting both to the second and to third voltage conversion part, and a control part that performs an operation stop control to stop the operation of at least one of the one or multiple heaters if the external input voltage has dropped below a first threshold voltage.

2. The heater control device according to claim 1, wherein at least a first switch is provided on a path that connects the second voltage conversion part and one of the heaters, a second switch is provided on an output path of the third voltage from which the third voltage conversion part outputs, and the control part performs the operation stop control by setting at least one of the first and second switches to an OFF state.

3. The heater control device according to claim 2, wherein if both the first and second switches are in an ON state, the control part performs the operation stop control by setting the first and second switches to the OFF state in a specified order.

4. The heater control device according to claim 3, wherein the specified order means that the control part sets the first switch to the OFF state earlier than the second switch.

5. The heater control device according to claim 2, wherein the control part sets at least one of the first and second switches to the OFF state after a first period passed since the external input voltage became below the first threshold voltage.

6. The heater control device according to claim 2, wherein if the external input voltage has recovered to become higher than the first threshold voltage, the control part releases the operation stop control by setting the first and second switches to an ON state.

7. The heater control device according to claim 6, wherein if both the first and second switches are in the OFF state, the control part releases the operation stop control by setting the first switch to the ON state earlier than the second switch.

8. The heater control device according to claim 6, wherein the control part sets the first and second switches to the ON state after a second period passed since the external input voltage has recovered to become larger than the first threshold voltage.

9. The heater control device according to claim 1, wherein the heaters are grouped by multiple types of heaters each of the types having different consumed power from one another, and the control part stops one type of the heaters as the operation stop control.

10. The heater control device according to claim 9, wherein the control part preferentially stops the operation of one type of the heaters having larger consumed power compared with the other type of the heaters.

11. The heater control device according to claim 9, wherein if the external input voltage has recovered to become larger than the first threshold voltage, the control part restores the operation of at least one type of the heaters by releasing the operation stop control.

12. The heater control device according to claim 11, wherein the control part preferentially restores the operation of the heaters having larger consumed power compared with the other type of the heaters.

13. The heater control device according to claim 1, wherein if the external input voltage has dropped below a second threshold voltage that is lower than the first threshold voltage, the control part stops the operation of the second voltage conversion part.

14. The heater control device according to claim 13, wherein a third switch is provided on the path between the first voltage conversion part and the second voltage conversion part, and the control part stops the operation of the second voltage conversion part by setting the third switch to an OFF state.

15. The heater control device according to claim 14, wherein immediately after the external input voltage has become below the second threshold voltage, the control part sets the third switch to the OFF state.

16. The heater control device according to claim 14, wherein if the external input voltage has recovered to become larger than the second threshold voltage, the control part restores the operation of the second voltage conversion part by setting the third switch to an ON state.

17. The heater control device according to claim 16, wherein immediately after the external input voltage has recovered to become larger than the second threshold voltage, the control part restores the operation of the second voltage conversion part by setting the third switch to the ON state.

18. The heater control device according to claim 1, wherein the one or multiple heaters is a fuser heater or a dew condensation prevention heater.

19. The heater control device according to claim 1, wherein the external input voltage and the second voltage are alternate current voltages, and the first and third voltages are direct current voltages.

20. An image forming apparatus, comprising:

one or multiple image forming parts, a first voltage conversion part that generates a first voltage based on an external input voltage that is input from an outside, a second voltage conversion part that generates a second voltage for supplying power to one or multiple heaters, which are provided inside the apparatus, based on the first voltage, a third voltage conversion part that generates a third voltage used at least in driving the one or multiple heaters based on the first voltage, a capacitative element that is electrically connected to a path that connects the first voltage conversion part to the second voltage conversion part and connects the first voltage conversion part to the third voltage conversion part, further the capacitative element being located in a section of the path that is used for connecting both to the second and to third voltage conversion part, and a control part that performs an operation stop control to stop the operation of at least one of the one or multiple heaters if the external input voltage has dropped below a first threshold voltage.

* * * * *